US005300386A

United States Patent [19]

Kanbayashi et al.

[11] Patent Number: 5,300,386

[45] Date of Patent: Apr. 5, 1994

[54] DEVELOPER FOR DEVELOPING ELECTROSTATIC IMAGE, IMAGE FORMING METHOD AND HEAT FIXING METHOD

[75] Inventors: Makoto Kanbayashi, Kawasaki; Takayuki Nagatsuka, Yokohama; Takashige Kasuya, Kawasaki; Tatsuya Nakamura; Tatsuhiko Chiba, both of Tokyo, all of Japan

[73] Assignee: Canon Kabushiki Kaisha, Tokyo, Japan

[21] Appl. No.: 854,832

[22] Filed: Mar. 20, 1992

[30] Foreign Application Priority Data

| | | | |
|---|---|---|---|
| Mar. 22, 1991 | [JP] | Japan | 3-81192 |
| Apr. 4, 1991 | [JP] | Japan | 3-97862 |
| Jul. 31, 1991 | [JP] | Japan | 3-213056 |
| Mar. 6, 1992 | [JP] | Japan | 4-49735 |

[51] Int. Cl.[5] ..... G03G 9/083

[52] U.S. Cl. ..... 430/99; 430/122; 430/137

[58] Field of Search ..... 430/110, 111, 106.6, 430/122, 99, 137

[56] References Cited

U.S. PATENT DOCUMENTS

| | | | |
|---|---|---|---|
| 2,297,691 | 10/1942 | Carlson | 430/107 |
| 3,578,797 | 3/1971 | Hodges et al. | 219/388 |
| 3,908,046 | 9/1975 | Fitzpatrick et al. | 427/216 |
| 4,950,573 | 8/1990 | Yamaguchi et al. | 430/111 |
| 5,118,587 | 6/1992 | Takaragi et al. | 430/111 |
| 5,118,588 | 6/1992 | Nair et al. | 430/100 |

FOREIGN PATENT DOCUMENTS

| | | |
|---|---|---|
| 36-10231 | 7/1961 | Japan . |
| 56-13945 | 4/1981 | Japan . |
| 57-51676 | 11/1982 | Japan . |
| 58-116559 | 7/1983 | Japan . |
| 59-53856 | 3/1984 | Japan . |
| 59-61842 | 4/1985 | Japan . |
| 60-120368 | 6/1985 | Japan . |
| 63-198075 | 8/1988 | Japan . |
| 63-271371 | 11/1988 | Japan . |
| 63-313182 | 12/1988 | Japan . |
| 1-187582 | 7/1989 | Japan . |
| 1-53786 | 11/1989 | Japan . |

OTHER PUBLICATIONS

Patent Abstracts of Japan, vol. 12, No. 354 (P-761) (3201) Sep. 22, 1988.

Patent Abstracts of Japan, vol. 14, No. 530 (P-1134) Nov. 21, 1990.

Japanese Patent Abstracts, Week 9048, Derwent, AN 90-358605 (48).

Japanese Patent Abstracts, Week 8817, Derwent, AN 88-116301 (17).

*Primary Examiner*—John L. Goodrou

*Attorney, Agent, or Firm*—Fitzpatrick, Cella, Harper & Scinto

[57] ABSTRACT

A developer for developing an electrostatic image is disclosed which has a toner including toner particles each containing a polymer, a copolymer or a mixture thereof and from 5 to 30% by weight of a low softening point material, and each having a plurality of concavities on its surface; the toner particles being prepared by suspension polymerization. Also, an image forming method and a heat fixing method using the developer are disclosed.

39 Claims, 5 Drawing Sheets

DEVELOPER FOR DEVELOPING ELECTROSTATIC IMAGE, IMAGE FORMING METHOD AND HEAT FIXING METHOD

BACKGROUND OF THE INVENTION

1. Field of the invention

The present invention relates to a developer for developing an electrostatic image, an image forming method, and a heat fixing method for fixing a toner image.

2. Related Background Art

A number of methods as disclosed in U.S. Pat. No. 2,297,691, etc. are hitherto known as method for carrying out electrophotography, which, in general, is a process in which copies are obtained by forming an electrostatic latent image on a photosensitive member by various means utilizing a photoconductive material, developing the latent image by the use of a toner, and transferring the toner image to a transfer medium such as paper if necessary, followed by fixing by the action of heat, pressure, heat-and-pressure, or solvent vapor. Methods for development using toners or methods of fixing toner images have been hitherto proposed in variety, and methods suited for any respective image-forming processes have been employed. In recent years, on such electrophotography, there is a demand for higher-speed copying and higher image quality.

As methods of producing toners, it is commonly known to use a process comprising melt-kneading a thermoplastic resin, a colorant such as a dye or a pigment and additives such as a charge control agent to effect their uniform dispersion, thereafter cooling the melt-kneaded product, pulverizing the cooled product by means of a pulverizer, and classifying the pulverized product by means of a classifier to give a toner having the desired particle diameter.

In the toners produced through the step of such pulverization, there is a limit in faithfully reproducing the latent image since in general their particles lack definite form, i.e., are amorphous. In order to achieve a high image quality using the toners produced by such pulverization, it is necessary to pulverize particles in a smaller diameter. However, making particle diameter smaller makes it necessary to use more energy and tends to make poor the yield of toner.

In addition, in the toners produced by such pulverization, there are limitations when a release material (a material with release properties) such as wax is added. For example, in order to make the release material have a dispersibility on a satisfactory level, there are limitations such that i) the material is not dissolved into a liquid state in the range of the temperature at which it is kneaded together with the resin, and ii) the release material must be contained in an amount not more than a given amount. Because of such limitations, there is a limit in improving the fixing performance of the toners produced by pulverization.

To cope with the problems in such amorphous toners, spherical toners have been proposed. For example, Japanese Patent Publication No. 56-13945 discloses a method of obtaining a spherical toner by melt-spraying. Japanese Patent Publication No. 57-51676 discloses a method of obtaining a spherical toner by adding to an amorphous toner an organic solvent in a small quantity followed by stirring under cooling. Japanese Patent Publication No. 36-10231 and Japanese Patent Applications Laid-open No. 59-53856 and No. 59-61842 also disclose a method of obtaining a spherical toner by suspension polymerization.

These spherical toners have uniform particle shapes and hence can readily adhere faithfully to the latent image. In particular, no minute irregularity occurs at the edges of the latent image to give a high image quality. In the case when the spherical toner is obtained by suspension polymerization, the toner particles can be readily made to have a smaller particle diameter and can be more suitable for achievement of a higher image quality.

The toner obtained by suspension polymerization (hereinafter "polymerized toner"), when compared with amorphous toners obtained by pulverization, can readily have a function of a capsular structure and hence can encapsulate wax in a large quantity, so that a good fixing performance and anti-offset properties can be expected.

As for the spherical toners, they tend to cause a deterioration of their performance even if various additives are used, making it difficult to obtain toners with a satisfactory durability. They also so strongly adhere to a photosensitive member that the toner cleaning after the transfer step tends to become insufficient. Several reports are seen on such problems.

In the method using suspension polymerization, toner particles are formed by dispersing in a dispersion medium as typified by water a polymerizable monomer composition substantially incompatible therewith, followed by polymerization. In order to obtain a toner with a sharp particle size distribution, it is a very important subject how stably droplets of the polymerizable monomer composition having been suspended in this aqueous dispersion medium, i.e., polymerizable monomer composition particles, are kept constant in diameter in the course of the polymerization.

To settle this subject, it is very important to make researches on dispersion stabilizers capable of imparting an appropriate surface tension to the interfaces between the droplets of a polymerizable monomer composition and the dispersion medium without adversely affecting environmental properties of toners as exemplified by moisture resistance. It is also very important how to conduct a post-treatment.

In recent years, copying apparatus or printers are not only used as a copying machine for office work to merely take copies of originals, but also has begun to be used in the field of printers serving as outputs of computers and in the field of personal copying of private use.

Under such circumstances, the apparatus are severely sought to be made small-sized, lightweight and of low power consumption, and copying machines have now been formed of more simple components. For example, as methods of developing electrostatic latent images, there are the two-component development, which makes use of a mixture comprised of a toner and a carrier, and the one-component development, which makes use of only a toner.

Non-magnetic one-component development as disclosed in Japanese Patent Applications Laid-open No. 58-116559, No. 60-120368 and No. 63-2711371 have attracted notice as development methods that can solve the problems discussed above.

In such non-magnetic one-component development, a developer is coated on a developer carrying member by means of a blade or the like to form a coat layer. The developer is electrostatically charged as a result of its friction with the blade or the surface of the developer carrying member. If the developer is coated in a thick layer, part of the developer can not be sufficiently charged, which causes fogging or toner scatter, and hence the developer must be coated in a thin layer. For this reason, the blade must be brought into pressure contact with the developer carrying member at a sufficient pressure. The force the developer receives at this time is larger than the force a developer receives in the two-component development or the one-component development making use of a magnetic toner. Hence the developer tends to be deteriorated and image deterioration such as fogging or density decrease tends to occur.

The developer used in the non-magnetic one-component development is required to have a large mechanical strength and thermal strength. However, an attempt to merely increase these strengths results in an increase in the heat energy required for the fixing, which is contradictory to the demand for the low power consumption. Thus, in the non-magnetic one-component development, higher performances are sought in both developing performance and fixing performance.

As a method of fixing a visible toner image to a recording medium, a heat-roll fixing system is widely used, in which a recording medium holding thereon a visible toner image having not been fixed is heated while it is held and carried between a heat roller maintained at a given temperature and a pressure roller having an elastic layer and coming into pressure contact with the heat roller. A belt fixing system is also known, as disclosed in U.S. Pat. No. 3,578,797.

The heat-roll fixing, however, has the following disadvantages:

(1) A time during which an image-forming operation is prohibited, i.e., what is called a waiting time, is required until the heat roller reaches a given temperature.

(2) The heat roller must be maintained at an optimum temperature in order to prevent poor fixing caused by the variations of the heat-roller temperature that may occur when the recording medium is passed or because of other external factors, and also to prevent the transfer of toner to the heat roller, i.e., what is called the offset phenomenon. This makes it necessary to make large the heat capacity of the heat roller or a heater element, which requires a large electric power and also causes in-machine temperature rise in the image forming apparatus.

(3) After the recording medium has been passed over the heat roller, the recording medium and the toner on the recording medium are slowly cooled because of a high temperature of the heat roller, resulting in a state in which a high adhesion of the toner is maintained. Thus, conjointly with the curvature of the roller also, there may often occur offset, or paper jam caused by the winding of the recording medium around the roller.

(4) A protective member must be provided on account of safety since there is a possibility of direct touch to the high-temperature heat roller.

The above problems (1) and (2) in the heat-roll fixing are not fundamentally solved also in the belt fixing system disclosed in U.S. Pat. No. 3,578,797.

Japanese Patent Application Laid-open No. 63-313182 discloses an image forming apparatus with a shorter waiting time and a low power consumption, comprising a fixing unit in which a visible toner image is heated via a movable heat-resistant sheet by means of a heating element having a low heat capacity, pulsewise generating heat by electrification, and is thus fixed to a recording medium. Japanese Patent Application Laid-open No. 1-187582 discloses a fixing unit for heat-fixing a visible toner image on a recording medium via a heat-resistant sheet, wherein said heat-resistant sheet comprises a heat-resistant layer and a release layer or a low-resistant layer, thereby effectively preventing the offset phenomenon.

In addition to the factors in the above fixing apparatus, however, achievement of both the excellent fixing performance of a visible toner image to a recording medium and the prevention of offset and simultaneous realization of a fixing method with a shorter waiting time and a low power consumption are greatly concerned with the properties of a toner. Thus, it is sought to provide a toner suited therefor.

SUMMARY OF THE INVENTION

An object of the present invention is to provide a developer for developing an electrostatic image, an image forming method and a heat fixing method that have solved the problems as discussed above.

Another object of the present invention is to provide a developer for developing an electrostatic image, that may cause less deterioration of external additives, may cause less changes in performance and has a superior durability, even in long-term running.

Still another object of the present invention is to provide a developer for developing an electrostatic image, containing a toner having superior fixing performance and anti-blocking properties.

A further object of the present invention is to provide a developer for developing an electrostatic image, containing a toner having a superior charge stability and storage stability.

A still further object of the present invention is to provide a developer for developing an electrostatic image, containing a toner that can achieve a high image density, a superior fine-line reproduction and a superior highlight reproduction.

A still further object of the present invention is to provide a developer for developing an electrostatic image, capable of preferably matching the higher copying speed.

A still further object of the present invention is to provide a developer for developing an electrostatic image, that can be preferably used in a full-color image forming method or multi-color image forming method.

A still further object of the present invention is to provide a developer for developing an electrostatic image, that does not tend to cause carrier wear.

A still further object of the present invention is to provide an image forming method that can achieve a high image density, causes no image deterioration such as fogging and can also achieve a superior fixing performance, even in long-term use in the non-magnetic one-component development.

A still further object of the present invention is to provide a heat fixing method that requires substantially no, or only a very short, waiting time and also a low power consumption, causes no offset phenomenon and can achieve good fixing of a toner image to a recording medium.

A still further object of the present invention is to provide a heat fixing method that employs no high-temperature revolving roller, thus requiring no heat-resistant special bearing.

A still further object of the present invention is to provide a heat fixing method using a fixing device so constituted as to prevent direct touch to high-temperature parts, thus achieving higher safety or requiring no protective members.

To achieve the above objects, the present invention provides a developer for developing an electrostatic image, comprising a toner comprising toner particles each containing a polymer, a copolymer or a mixture thereof and from 5 to 30% by weight of a low softening point material, and each having a plurality of concavities on its surface; said toner particles being prepared by suspension polymerization.

As another embodiment of the developer, the present invention provides a developer for developing an electrostatic latent image, comprising a toner comprising toner particles; said toner particles being prepared by suspension polymerization, each containing at least two components comprised of a high softening point resin-A and a low softening point material-B, and each having a structure separated into a phase-A mainly composed of said resin-A and a phase-B mainly composed of said material-B, said phase mainly composed of said material-B being absent in the vicinity of the toner particle surface ranging from its surface to a depth 0.15 time a toner particle diameter; and a dispersion stabilizer being present on the surfaces of said toner particles in an amount of not more than 0.2% by weight based on the weight of said toner.

The present invention also provides an image forming method comprising;

forming on a developer carrying member a magnetic brush layer formed of a developer; said developer comprising toner particles and magnetic particles; said toner particles each being prepared by suspension polymerization, containing at least two components comprised of a high softening point resin-A and a low softening point material-B, and each having a structure separated into a phase-A mainly composed of said resin-A and a phase-B mainly composed of said material-B, said phase mainly composed of said material-B being absent in the vicinity of the toner particle surface ranging from its surface to a depth 0.15 time a toner particle diameter;

applying across said developer carrying member and a latent image bearing member, a bias electric field formed of an alternating current component and a direct current component; and forming in a developing zone defined by said latent image bearing member and said developer carrying member, a magnetic brush in such a manner that said magnetic particles are in a volume percentage of from 10% to 40%.

As another embodiment of the image forming method, the present invention provides an image forming method comprising;

feeding a toner to a developer carrying member by means of a feed roller; said toner comprising non-magnetic toner particles; said non-magnetic toner particles being prepared by suspension polymerization, each containing at least two components comprised of a high softening point resin-A and a low softening point material-B, and each having a structure separated into a phase-A mainly composed of said resin-A and a phase-B mainly composed of said material-B, said phase mainly composed of said material-B being absent in the vicinity of the toner particle surface ranging from its surface to a depth 0.15 time a toner particle diameter;

forming a toner layer on said developer carrying member by means of a developer coating blade provided downstream said feed roller; and developing with said toner an electrostatic image formed on a latent image bearing member set opposingly to said developer carrying member.

The present invention still also provides a heat fixing method comprising;

carrying a visible image of a toner onto a recording medium; said toner comprising toner particles; said toner particles being prepared by suspension polymerization, each containing at least two components comprised of a high softening point resin-A and a low softening point material-B, and each having a structure separated into a phase-A mainly composed of said resin-A and a phase-B mainly composed of said material-B, said phase mainly composed of said material-B being absent in the vicinity of the toner particle surface ranging from its surface to a depth 0.15 time a toner particle diameter; and bringing said recording medium into close contact with a heating element by means of a pressure member with a film interposed between them, to heat-fix said visible image of said toner onto said recording medium.

DESCRIPTION OF THE PREFERRED EMBODIMENTS

Figure 1:
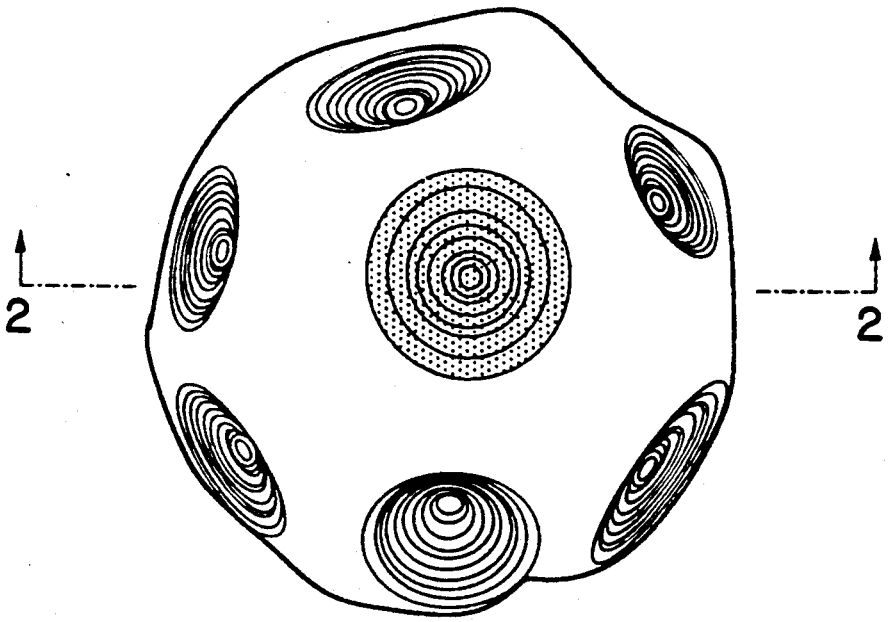
FIG. 1 schematically illustrates an outer shape of a toner particle of the present invention.

According to a discovery made by the present inventors, in the toner produced by suspension polymerization, each toner particle may be provided on its surface with concavities and may be made to have a capsular structure that encapsulates a low-melting wax, so that an improvement in fixing performance, blocking resistance, and durability to copying on a large number of sheets can be improved; and the quantity of a dispersion stabilizer remaining and adhering on the toner particle surfaces may be controlled, so that a toner having a superior charge stability and storage stability can be obtained.

According to another discovery made by the present inventors, the deterioration of durability and the poor cleaning performance in instances in which various external additives are used in spherical toners are mainly caused by the shapes of toner particles. More specifically, in the case when toner particles have spherical shapes, the friction, e.g., between toner particles, between a toner and a carrier or between a toner and a sleeve tends to take place more than in the case of amorphous toners, and hence any additives adhering to the surfaces of toner particles and freely movable tend to be embedded in the toner particle surfaces to tend to inhibit their functions, and tend to bring about a lowering of durability and cleaning performance.

On the basis of such discoveries, the present inventors made further studies to accomplish the present invention. That is, they have discovered that deterioration of various external additives can be prevented by forming a plurality of appropriate concavities on the surface of each toner particle, and the cleaning can be efficiently carried out by counter blade cleaning. Moreover, the toner of the present invention can give a high-quality image.

In the present invention, as the external additive, it is preferable to use at least one of a fluidity-providing agent, a lubricant and an abrasive.

Use of a fluidity-providing agent makes it possible to weaken the van der Waals force applied to the toner, so that the toner behaves faithfully to the Coulomb force. As a result, the toner can readily move from a developer carrying member such as a developing sleeve to the latent image formed on a photosensitive member, so that a high image density can be obtained. Since also the latent image can be faithfully developed, it is possible to obtain a fog-free developed image. Moreover, use of the fluidity-providing agent makes it easy to feed the toner. In the case of two-component developers, its use improves mixing properties of magnetic particles, so that the toner becomes well chargeable.

In general, such a fluidity-providing agent has a fluidity-providing ability which is higher with a decrease in particle diameter. When used in conventional spherical toners, the fluidity-providing agent tends to be embedded into the toner particles because of its small particle diameter, and hence tends to lose its fluidity-providing effect.

As a countermeasure thereto, the present inventors have discovered that a toner not tending to cause deterioration of the fluidity-providing ability can be obtained when a toner produced by suspension polymerization and comprised of a particle with concavities on its surface is used in combination with the fluidity-providing agent.

Making of toners having a small particle diameter so that a toner image with a high image quality can be obtained brings about a difficulty in toner cleaning and tends to result in an image with marks of faulty cleaning. In the present invention, toner particles are each provided with concavities on their surfaces. This makes it not liable for the additives to undergo deterioration and also makes it possible for toner particles to less adhere to the surface of a photosensitive member over a long period of time, so that the toner can be readily cleaned even when made to have a small particle diameter.

As previously noted, each toner particle in the present invention has a plurality of concavities, which may preferably partially provided on its surface. More preferably, with respect to a projected area of the toner particle, its maximum inscribed circle corresponding to its radius r and minimum circumscribed circle corresponding to its radius R satisfy the expression:

$$1.00 < R/r \leqq 1.20,$$

and still more preferably satisfy the expression:

$$1.02 < R/r \leqq 1.15.$$

With an increase in the value of R/r, the particle tends to become less spherical. Its value more than 1.20 is not preferable since the particle become excessively less spherical. The toner comprised of such a particle may preferably have a weight average particle diameter of from 3 to 12 μm.

In the present invention, circumferential length L and circumferential length $2\pi r$ of a projected area of the particle may preferably satisfy the relationship of:

$$1.01 < L/2\pi r < 2.00,$$

and more preferably satisfy the relationship of:

$$1.02 < L/2\pi r < 1.50.$$

A particle with $L/2\pi r$ smaller than 1.01 results in a particle having few concavities. On the other hand, a value larger than 2.00 is not preferable since the particle comes to have a large number of minute or fine concavities, or have concavities with great differences in depth. In the case of the former, the concavities are too fine to readily give the operational effect. In the case of the latter, the particle becomes approximate to a substantially amorphous particle, making it difficult to obtain a high image quality and also tending to bring toner particles into a finely powdered state in a developing assembly.

Figure 3:
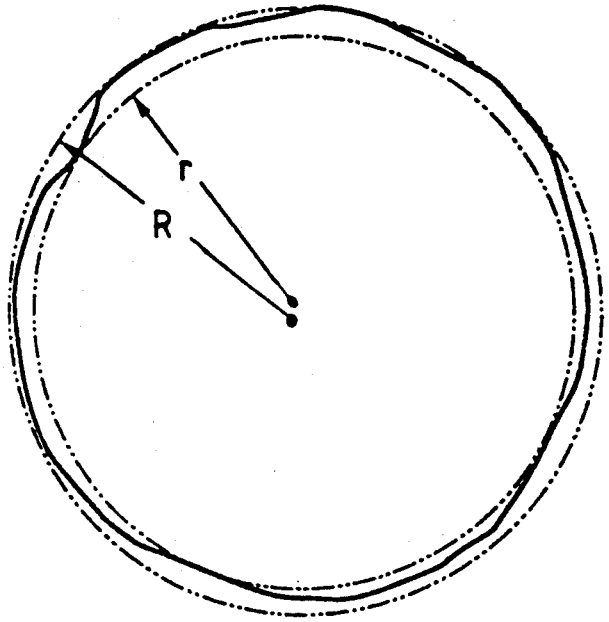
FIG. 3 illustrates a maximum inscribed circle and a minimum circumscribed circle, of a toner particle.
Figure 4:
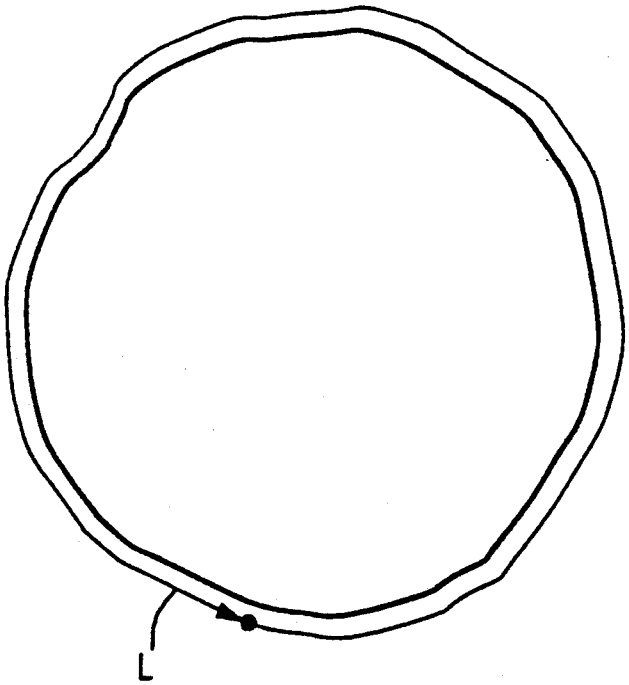
FIG. 4 illustrates a circumferential length L of a toner particle.

The projected area of the toner particle in the present invention refers to an image obtained by focusing the lens of an electron microscope on the contour of a toner particle at magnification of at least 2,000, and preferably 5,000. Using Luzex 5000, the radius r of its inscribed circle and the radius R of its circumscribed circle are also determined as shown in FIG. 3. The circumferential length L is also determined as shown in FIG. 4.

These R, r and L are measured on at least 50, and preferably 100 or more, toner particle images, and average values thereof may preferably satisfy the relationships set out above.

The toner particle of the present invention has the concavities on its surface. FIG. 1 shows an example of the surface shape. Such concavities bring about an increase in contact points between toner particles but instead bring about a decrease in pressure at every contact point, so that the additives can be hindered from being embedded into the toner particle and also the blocking resistance can be improved.

In general, the addition of a fluidity-providing agent to a toner may bring about an improvement in blocking resistance because of the fluidity-providing agent serving as a spacer. As previously stated, however, when used in the conventional spherical toners prepared by suspension polymerization, the various external additives such as the fluidity-providing agent tend to fix on toner particle surfaces because of the stress produced by vigorous motion in a developing assembly and tend to cause a phenomenon of inhibiting the functions of the external additives.

In the present invention, on the other hand, the concavities on the toner particle surface prevent the external additives from being deteriorated, and hence a good blocking resistance can be maintained for a long period of time.

Figure 2:
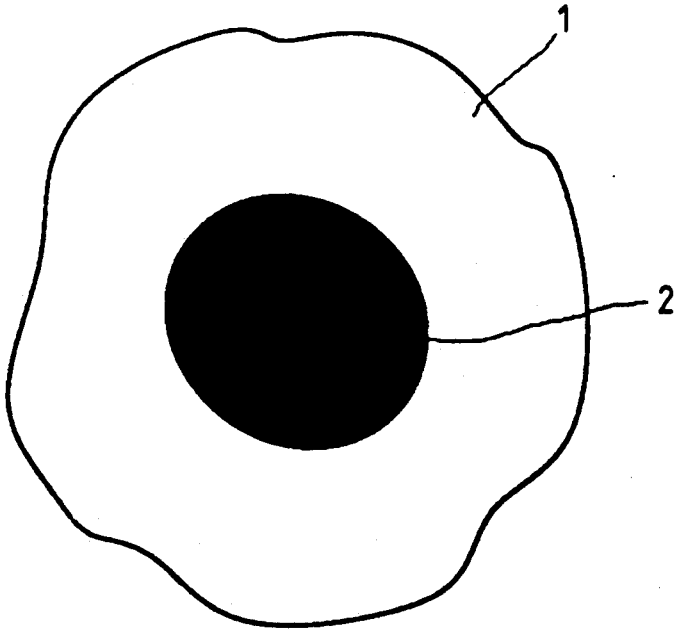
FIG. 2 schematically illustrates a cross section along the line A—A in FIG. 1, of a toner particle of the present invention.

The toner particle of the present invention may also preferably have a surface layer portion 1 (phase-A) and a central portion 2 (phase-B) and may preferably be separated into two phases with a distinct boundary between them, as shown in FIG. 2. A capsular structure thus given to each particle, which functionally separates the particle into the surface layer portion 1 and the central portion 2, enables preferable toner designing. Stated specifically, a high softening point resin is used in the surface layer portion so that the toner can have a blocking resistance or a strong resistance to its vigorous motion in a developing assembly, and a low softening point material is used in the central portion so that the toner can have a superior fixing performance at the same time. In addition, a release material with a low melting point may have been incorporated in the center, which may be forced to exude therefrom by the application of pressure during fixing, so that the anti-offset properties can be remarkably improved. Charge control properties may be imparted to the surface layer portion.

The particle in the present invention has a more definite double-layer structure than quasi-capsules disclosed in Japanese Patent Publication No. 1-53786, and therefore the inside materials do not easily exude to the surface layer in the usual condition. Hence, a remarkable improvement is brought about also in preventing the phenomenon that the inside low softening point material contaminates a carrier or a developing sleeve. In particular, this function can be effective when the low softening point material is contained in a large quantity.

Stated specifically, the toner particle contains at least two resin components, component-A and component-B, in a proportion A:B of from 50:50 to 95:5, and has a structure separated in to a phase mainly composed of component-A and a phase mainly composed of component-B. The phase mainly composed of component-A forms a surface layer and the phase mainly composed of component-B is present at the center. As described above, a preferable combination is set up when the phase mainly composed of component-A has a high softening point and the phase mainly composed of component-B has a low softening point. Preferred is a combination which undergoes phase separation into the phase mainly composed of component-A and the phase mainly composed of component-B as the suspension polymerization proceeds.

The component-A may preferably have a molecular weight of from 5,000 to 200,000 as weight average molecular weight measured by gel permeation chromatography (GPC), and the component-A may preferably have melt properties such that it has a flow-out point (a point at which the resin begins to flow out) of from 65° to 100° C. when measured with a flow tester.

The component-A that forms the surface layer of the toner particle may be produced from polymerizable monomers as exemplified by the following: Styrene; styrene monomers such as o-methylstyrene, m-methylstyrene, p-methylstyrene, p-methoxystyrene and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and monomers such as acrylonitrile, methacrylonitrile and acrylamide.

Any of these polymerizable monomers can be used alone or in the form of a mixture. Of the above polymerizable monomers, it is preferred in view of developing performance and durability to use styrene or a styrene derivative alone or to use styrene or a styrene derivative in combination with other monomer.

The low softening point material (component-B) may preferably have a weight average molecular weight of from 300 to 10,000 as measured by GPC, and may preferably have a melting point of from 30° to 130° C., and more preferably from 60° to 100° C. A resin with a melting point lower than 30° C. tends to increase the possibility of low-temperature offset during fixing. On the other hand, a resin with a melting point higher than 130° C. tends to cause solidification of the component-B during the manufacture of the toner and also tends to make granulation properties poor.

Use of a wax as the low softening point material makes the present invention more effective. The wax used in the present invention may include paraffin, polyolefin waxes and modified products of these as exemplified by oxides or grafted products, higher fatty acids and metal salts thereof, and amide waxes.

The low softening point material may preferably be contained in an amount of from 5 to 30% by weight on the basis of the weight of the toner.

The component-A and component-B may preferably be in a proportion A:B of from 50:50 to 95:5, and more preferably from 70:30 to 90:10. If the component-B is more than the proportion A:B of 50:50, it becomes difficult to retain the capsular structure, and if it is less than the proportion A:B of 95:5, it becomes difficult to obtain the operational effect attributable to the component-B.

The main part of the phase B mainly composed of a low softening point material may be present in the center of the toner particle and the area of the phase-B in a cross section of the toner particle may hold from 10% to 45%. These are preferable in view of durability, fixing performance and anti-offset properties.

In the toner of the present invention, the phase mainly composed of the component-B is preferably absent in the vicinity of the toner particle surface ranging from its surface to a depth 0.15 time a toner particle diameter. Stated conceptually, this means that the surface layer has a thickness 0.15 time or more the toner particle diameter. For example, even a configuration in which cracks are present and some parts of the surface layer do not have a thickness 0.15 times the toner particle is included in the scope of the present invention so long as the phase mainly composed of component-B is absent in the cracks. If the phase mainly composed of component-B is present in the vicinity of the toner particle surface ranging from its surface to a depth 0.15 time a toner particle diameter, the capsular structure may become unstable to tend to result in, for example, a poor blocking resistance.

The concavities on the surface, which are one of the features of the present invention, can be preferably attained by dissolving in monomers a given amount of a specific polar resin soluble in the monomers capable of producing the component-A that mainly forms the surface layer, followed by granulation and suspension polymerization.

The polar resin may include, for example, as cationic polymers, polymers of nitrogen-containing polymerizable monomers as exemplified by dimethylaminoethyl methacrylate and diethylaminoethyl methacrylate, or copolymers of styrene or unsaturated carboxylates and nitrogen-containing polymerizable monomers; as anionic polymers, polymers of nitrile monomers such as acrylonitrile, halogen-containing monomers such as vinyl chloride, unsaturated carboxylic acids such as acrylic acid and methacrylic acid, unsaturated dibasic acids, unsaturated dibasic anhydrides or nitro monomers, or copolymers of any of these monomers and styrene or a styrene monomer. Examples are by no means limited to those set out here.

Of these polar resins, it is particularly preferable to use those having a ratio of weight average molecular weight to number average molecular weight (Mw/Mn), as measured by GPC, of not more than 10, and more preferably not more than 5. Granulation and suspension polymerization carried out by adding such a polar resin to monomers promote the phase separation into the phase mainly composed of component-A (phase-A) and the phase mainly composed of component-B (phase-B). In other words, the boundary between phase-A and phase-B becomes distinct, and the concentration of the component-B contained in the phase-A becomes extremely low. As a result, the capsular structure of the toner particle itself becomes more remarkable, making it possible to achieve both the improvement in blocking resistance and the improvement in fixing performance.

Such a tendency is more remarkable as the polar resin has a higher acid value, and the phase separation is promoted when its acid value is not less than 20, and preferably not less than 30. Moreover, the polar resin with a high acid value tends to be localized in the vicinity of the toner particle surface in the phase-A, so that this resin greatly affects the shape of the particle surface, making it possible to produce the toner particle with concavities in the form its surface has been caved in. Although details are unclear, it is presumed as follows: The polar resin with a high acid value is concentrated in the vicinity of the toner particle surface in the step of granulation and at the initial stage of the suspension polymerization, and, as the reaction of polymerization of monomers proceeds, comes to be present in the vicinity of the surface as a sort of an aggregate in which the polar resins have gathered. After a while, once the volume shrinkage of suspended particles begins to take place as a result of the polymerization of monomers, the degree of shrinkage becomes different depending on the manner in which the polar resin is localized, and soon after the shaped toner particles in the form that their surfaces are each concave in part and in plurality are produced. Such an effect can be obtained with difficulty when a polar resin with an acid value less than 20 is used.

On the other hand, a polar resin with an excessively high acid value may bring the state of toner particle surfaces into disorder to cause a lowering of granulation properties. Hence, the polar resin should preferably have an acid value of from 20 to 100, and more preferably from 30 to 80. Even with the acid value in the range of from 30 to 80, a polar resin with an Mw/Mn more than 10 may be accompanied with a difficulty in its uniform dispersion in monomers, tending to make it difficult to obtain the toner having the intended particle size distribution. Thus it is not preferable to use a polar resin having so extremely large Mw that it can not be uniformly dissolved in the monomers. The toner particle can not be concave also when the polymerization is carried out using, in place of the polar resin, polar monomers having a polar group. Polymerization carried out using a large quantity of such polar monomers rather tends to result in an extreme lowering of granulation properties.

It is preferred to use a polar resin having an weight average molecular weight of from 10,000 to 200,000.

The polar resin may be used in an amount of from 0.1 part by weight to 10 parts by weight based on 100 parts by weight of polymerizable monomers. Use of the polar resin in an excessively small amount is not preferable since the toner particles may be less shaped. On the other hand, use of the polar resin in an excessively large amount makes it difficult to granulate a polymerizable monomer composition in an aqueous dispersion medium and makes it difficult to obtain toner particles with a sharp particle size distribution.

In general, in the suspension polymerization, toner particles are formed by dispersing in a dispersion medium such as water a polymerizable monomer composition substantially incompatible therewith, followed by polymerization. In order to obtain a toner with a sharp particle size distribution, it is a very important subject how stably droplets of the polymerizable monomer composition having been suspended in this aqueous dispersion medium, i.e., polymerizable monomer composition particles, are kept constant in diameter in the course of the polymerization.

To settle this subject, it is very important to find out dispersion stabilizers capable of imparting an appropriate surface tension to the interface between the droplets of a polymerizable monomer composition and the dispersion medium without adversely affecting environmental properties of toners as exemplified by moisture resistance. With regard to the dispersion stabilizers, the present applicant or assignee has proposed a method making use of a dispersion stabilizer that can make sharp the particle size distribution of toners and also may less affect the developing performance, which is a method of preparing a polymerized toner by using a slightly water-soluble inorganic dispersant and controlling the pH of a dispersion medium to give a toner with a preferable particle diameter (Japanese Patent Application Laid-open No. 63-198075).

In the dispersion medium used in the present invention, a suitable dispersion stabilizer can be used. For example, as a dispersion stabilizer comprising a slightly water-soluble inorganic compound, it may include calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate and barium sulfate.

Such a slightly water-soluble inorganic compound may preferably have a particle diameter not larger than 3 μm, and more preferably not larger than 2 μm, as primary particles.

These inorganic compounds may be in the form of powdered inorganic compounds, which may be used as they are. They may preferably be slightly water-soluble inorganic compounds produced in water in the presence of substances such as sodium phosphate and calcium chloride, which may be used as they are. The latter method is preferred in view of the advantage that inorganic compounds kept in the state of fine particles and having a good dispersibility can be readily obtained.

In general, the agglomeration which the powdered, slightly water-soluble inorganic compounds undergo is usually in a strongly agglomerated state and also in such a state that the resulting agglomerates have non-uniform particle diameters. Hence, it is often necessary to carry out their dispersion in water with much care when such powder is used. However, use of the method in which the slightly water-soluble inorganic compound is produced in water as described above makes it possible to readily obtain a well dispersed state of the inorganic compound.

Moreover, when the slightly water-soluble inorganic compound is produced in water in this way, a water-soluble neutral salt formed together with the slightly water-soluble inorganic compound is effective for both preventing polymerizable monomers from dissolving in water and making larger the specific gravity of the aqueous medium.

Examples of the reaction to produce the slightly water-soluble inorganic compound are shown below. Examples are by no means limited to these.

$$2Na_3PO_4+3CaCl_2 \rightarrow Ca_3(PO_4)_2+6NaCl \quad (1)$$

$$2Na_3PO_4+Al_2(SO_4)_3 \rightarrow 2AlPO_4+3Na_2SO_4 \quad (2)$$

$$2Na_3PO_4+3ZnSO_4 \rightarrow Zn_3(PO_4)_2+3Na_2SO_4 \quad (3)$$

$$Na_2PO_3+Zncl_2 \rightarrow ZnCO_3+2NaCl \quad (4)$$

$$Na_2PO_3+ZnSO_4 \rightarrow ZnCO_3+Na_2SO_4 \quad (5)$$

In the method described above, the slightly water-soluble inorganic compound may optionally be used in combination of two or more kinds. Such a slightly water-soluble inorganic dispersant may preferably be used in an amount of from 1 to 20% by weight, and more preferably from 1 to 10% by weight, on the basis of the weight of the polymerizable monomer composition.

Satisfactory results can be obtained in respect of the particle size distribution, toner particle shape and toner particle internal structure when calcium phosphate is used as the dispersion stabilizer, making the present invention more effective.

The calcium phosphate may be in the form of powder, which may be used as it is. As previously described, it may preferably be calcium phosphate produced in water in the presence of substances such as sodium phosphate and calcium chloride, which may be used as it is. The latter method is preferred.

Use of the latter method makes it possible to obtain a very fine salt to give a stable suspended state, resulting in good granulation properties. In respect of the toner particle shape, it becomes also possible to give a preferable size and number of concavities on the surface. Moreover, because of stable particles of the polymerizable monomer composition, the phase separation into component-A and component-B can be accelerated to greatly contribute the formation of the internal structure of toner particles and the promotion of the double-phase structure, as in the present invention.

In the present invention, employed is a method in which, after it has been confirmed that the monomer composition particles thus formed have the desired particle size, the polymerization reaction is carried out while controlling the liquid temperature (for example, 55° to 70° C.) of the aqueous dispersion medium containing the particles, or a method in which the polymerization reaction is carried out simultaneously with the granulation and dispersion, while controlling the liquid temperature of the aqueous dispersion medium.

After the polymerization reaction of the monomer composition has been completed, the reaction product may be post-treated by a conventional method using, for example, HCl, so that the toner produced by suspension polymerization (polymerized toner) can be obtained. For example, a Brønsted acid may be added to the system containing the polymer particles thus formed, to remove the powdery slightly water-soluble inorganic dispersant, and thereafter suitable means such as filtration, decantation and centrifugal separation may be carried out to collect the polymer particles, followed by drying. The toner can be thus obtained.

The slightly water-soluble inorganic dispersant, which is soluble in the Brønsted acid used in the present invention, can be relatively readily removed from the toner particle surfaces upon the acid (or alkali) treatment mentioned above.

Under existing circumstances, little study has been made on the correlation between hydrophilicization of toner particle surfaces which is attributable to the dispersion stabilizer remaining thereon, and charge performance of the toner.

In the present invention, extensive studies made in this respect have revealed the following: The slightly water-soluble inorganic dispersant as described above can be removed by dropwise adding a Bronsted acid to the dispersion medium to lower the pH of the solution. If the acid is added in an isufficient amount or the post-treatment is in a short time, it can not be well removed, resulting in a lowering of charge performance to tend to make unstable the charge performance in a high-temperature and high-humidity environment.

Especially when the polar resin is used, the dispersion stabilizer remaining has a remarkable influence. Although details are unclear, when the quantity of the remaining inorganic dispersant is varied by giving variety to the pH, the triboelectric charge performance of toners is lowered, in particular, the charge stability in a high-temperature and high-humidity environment is lowered in the case when the inorganic dispersant is present in a quantity more than 0.2% by weight on the basis of the weight of the polymerizable monomer composition. This tends to greatly occur in the case when the fluidity and charge performance are controlled using various external additives. This tendency is more remarkable in a system in which the inorganic dispersant is added in a little larger amount so that the toner can be made to have a smaller particle diameter. This is presumably because of water absorption in the remaining inorganic dispersant.

On the other hand, complete absence of the inorganic dispersant on the toner particle surfaces results in an excessive quantity of triboelectricity of the toner when developing is carried out in a low-humidity environment, tending to cause charge-up.

In the present invention, the inorganic dispersant or dispersion stabilizer remaining may preferably be controlled in an amount of from 0.005% by weight to 0.2% by weight, and more preferably from 0.01% by weight to 0.2% by weight, on the basis of the weight of the toner, by adding the acid such as HCl so as to adjust the pH of the dispersion medium to 3 or less (preferably 2.5 or less).

The toner used in the present invention can be obtained, for example, by the following method. A release agent, a colorant, a charge control agent, a polymerization initiator and other additives are added to polymerizable monomers, which are then uniformly dissolved or dispersed using a homogenizer, an ultrasonic dispersion machine or the like to give a polymerizable monomer composition. The composition thus prepared is dispersed in an aqueous medium containing a dispersion stabilizer, using a conventional stirring machine or a high-shear mixer such as a homomixer or a homogenizer. Preferably the granulation is carried out by so controlling the stirring speed and time that the droplets of the monomer composition have the diameters corresponding to the desired particle diameters of toner particles, usually particle diameters of 30 μm or less, e.g., from 1 to 20 μm, and preferably from 4 to 10 μm. Thereafter, the dispersion stabilizer acts to maintain the state of particles, where the stirring may be carried out to the extent that the particles are prevented from settling or floating. After the reaction has been completed, the dispersion stabilizer is removed, and the toner particles thus formed are washed and then collected by filtration, followed by drying. In the suspension polymerization, water may preferably be used as the dispersion medium usually in an amount of from 300 to 3,000 parts by weight based on 100 parts by weight of the monomer composition.

In the suspension polymerization described above, the polymerization may be carried out at a temperature of 40° C. or higher, and preferably at a temperature set within the range of from 50° to 90° C.

At this time, the polymerization temperature may be controlled in such a way that it is further raised by 5° to 30° C. during, i.e., at some time in the course of, the polymerization. Raising the temperature during the polymerization is effective for increasing the degree of concavities on the toner particle surfaces. Raising the temperature is also presumed to be contributory to the acceleration of the phase separation into phase-A and phase-B.

The polymerization initiator may include, for example, azo or diazo type polymerization initiators such as 2,2'-azobis(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile, and azobisisobutylonitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. Any of these polymerization initiators may be used in an amount of from 0.5 to 20% by weight on the basis of the weight of the polymerizable monomers.

In the present invention, a cross-linking agent may be added to the monomer composition. It may be added preferably in an amount of from 0.001 to 15% by weight on the basis of the weight of the polymerizable monomers.

In the present invention, a charge control agent may preferably be previously added to the toner for the purpose of controlling charge performance of the toner. Among known charge control agents, those having little polymerization inhibitory action and little aqueous-phase shifting properties are used the charge control agent. For example, a positive charge control agent may include Nigrosine dyes, triphenylmethane dyes, quaternary ammonium salts, and amine or polyamine compounds. A negative charge control agent may include metal-containing salicylic acid compounds, metal-containing monoazo dye compounds, a styrene/acrylic acid copolymer, and a styrene/methacrylic acid copolymer.

As the colorant used in the present invention, known colorants can be used, which are exemplified by dyes such as carbon black, C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6; and pigments such as chrome yellow, cadmium yellow, Mineral Fast Yellow, Navel Yellow, Naphtol Yellow S, Hanza Yellow G, Permanent Yellow NCG, Tartrazine Yellow Lake, molybdenum orange, Permanent Orange GTR, Benzidine Orange G, cadmium red, Permanent Red 4R, Watchung Red calcium salt, Brilliant Carmine 3B, Fast Violet B, Methyl Violet Lake, prussian blue, cobalt blue, Alkali Blue Lake, Victoria Blue Lake, quinacridone, Rhodamine Lake, Phthalocyanine Blue, Fast Sky Blue, Pigment Green B, Malachite Green Lake, and Final Yellow Green G.

Since in the present invention the toner is obtained by suspension polymerization, care must be taken on the polymerization inhibitory action and aqueous-phase shifting properties inherent in colorants. The colorant should preferably be previously surface-modified, for example, treated to be made hydrophobic using a material having no polymerization inhibitory action. In particular, since most of dyes or carbon black have polymerization inhibitory action, care must be taken when they are used. A preferable method for the surface treatment of dyes may include a method in which polymerizable monomers are previously polymerized in the presence of any of these dyes, where the resulting colored polymer may preferably be added to the monomer composition. With regard to carbon black, it may be subjected to the same treatment as the above dyes, or, alternatively, to graft treatment using a material capable of reacting with surface functional groups of carbon black, as exemplified by polyorganosiloxane.

In the present invention, a magnetic material may be added to the toner particles, which may preferably be used after application of similar surface treatment.

The additives used in the present invention for the purpose of providing various properties may preferably have a particle diameter of not more than 1/10 of the weight average particle diameter of the toner particles in view of the durability required when added to the toner. The particle diameter of the additives refers to an average particle diameter determined by observing toner particle surfaces using an electron microscope. The additives used for the purpose of providing the desired properties can be exemplified by the following. Examples are by no means limited to these.

1) The fluidity-providing agent may preferably include metal oxides such as silicon oxide, aluminum oxide and titanium oxide, carbon black, and fluorocarbon, all of which may more preferably having been subjected to hydrophobic treatment.

2) The abrasive may preferably include metal oxides such as strontium titanate, cerium oxide, aluminum oxide, magnesium oxide and chromium oxide, nitrides such as silicon nitride, carbides such as silicon carbide, metal salts such as calcium sulfate, barium sulfate and calcium carbonate.

3) The lubricant may preferably include fluorine type resin powders such as vinylidene fluoride and polytetrafluoroethylene, and fatty acid metal salts such as zinc stearate and calcium stearate.

4) Charge control particles may preferably include metal oxides such as tin oxide, titanium oxide, zinc oxide, silicon oxide and aluminum oxide.

These additives may be used in an amount of from 0.1 part by weight to 10 parts by weight, and preferably from 0.1 part by weight to 5 parts by weight, based on 100 parts by weight of the toner. These additives may be used alone or in combination of plural ones.

As previously described, the toner of the present invention has a plurality of concavities on the surface of its each particle. An example of the shape of the toner particle surface is shown in FIG. 1. Because of such a plurality of concavities, the carrier and the sleeve can be better prevented from being contaminated. The presence of the concavities on the surfaces of toner particles also contributes an improvement in cleaning performance. Moreover, since the toner particle is approximate to a sphere, a toner image with a high image quality can be obtained. Since also no pulverization or size reduction of toner particles tends to occur because of their vigorous motion in a developing assembly, any fogging or toner scatter due to fine powder does not occur.

Figure 5:
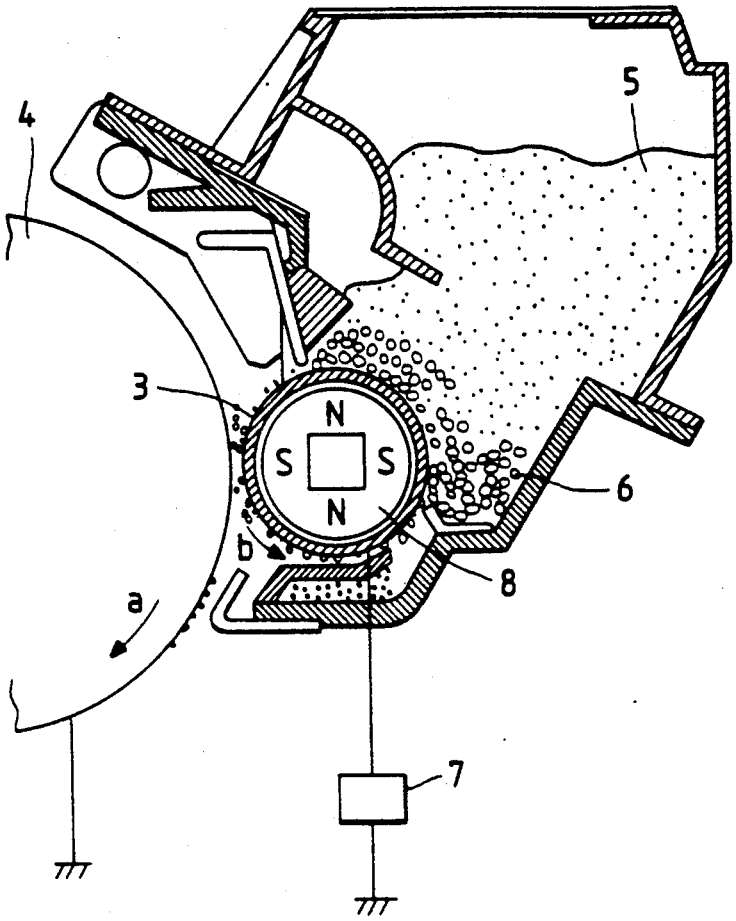
FIG. 5 schematically illustrates an example of a developing apparatus for carrying out the image forming method of the present invention.

The image forming method of the present invention can be carried out using, for example, the developing apparatus shown in FIG. 5. In the developing apparatus shown in FIG. 5, a bias electric field comprised of an AC component and a DC component is applied across a developer carrying member (a sleeve) and a latent image bearing member (a photosensitive member). This brings toner and magnetic particles into a state of vigorous oscillation and flying. Such oscillation and flying of toner and magnetic particles bring about the following advantages.

That is, development efficiency becomes very high since the developing is carried out by causing the toner to fly from both a magnetic brush and the surface of the developer carrying member. Hence the coating weight of developer can be relatively small, and the resolution of a developed image can be improved. Because of the high development efficiency, it is possible to make substantially equal the relative speed between the developer carrying member and the photosensitive member, and hence any sweep-up at a developed solid image area does not tend to occur, which may occur when a relative speed is made. There is another advantage that the sweep-up can be decreased even when the relative speed is made.

Since the magnetic particles undergo oscillation attributable to the alternating electric field, no line marks of the magnetic brush does not occur and hence a developed image with a very high image quality can be obtained. Moreover, application of the alternating electric field necessary only for the magnetic particles to move across the space defined by the developer carrying member and the photosensitive member allows the magnetic particles to behave together with the toner at image areas when they fly in the manner stated above, so that development an be accelerated. At background areas, the magnetic particles behave conversely to the toner to become effective for separating the toner having adhered to the surface of the photosensitive member, so that fogging can be prevented. Furthermore, the magnetic particles having adhered to the surface of the photosensitive member can also be finally drawn back to the side of the developer carrying member by the magnetism and the mobile force attributable to the electric field thereby produced, so that the quantity of magnetic particles adhering to the photosensitive member can be decreased. Even when ears formed of magnetic particles are localized, they collapse in part when magnetic particles fly, to bring about an effect of leveling the magnetic particles.

Now, the volume percentage of magnetic particles in the developing zone will be described with reference to FIGS. 6 and 7. The "developing zone" is meant to be an area in which a toner 5 (FIG. 5) is transferred or fed from a developer carrying member (a sleeve) 3 to a photosensitive drum (a latent image bearing member) 4. The "volume percentage" refers to percentage of the volume held by magnetic particles 6 present in this developing zone, with respect to the capacity of that zone. As a result of various experiments and examinations, it has been discovered that this volume percentage has an important influence in the above developing apparatus and that it is very preferable for the percentage to be set within the range of from 10% to 45%, and particularly from 15% to 28%. A volume percentage less than 10% is not preferable in view of the disadvantages that developed image density may decrease, sleeve ghost may occur, a remarkable density difference may occur between a portion at which ears are present and a portion at which they are absent, and the thickness of a developer layer formed on the sleeve surface may become uneven as a whole. On the other hand, a volume percentage more than 45% is not preferable in view of the disadvantage that the magnetic particles may shut up the sleeve surface to cause fogging.

In particular, the present invention is not based on the fact that image quality is incrementally deteriorated or improved with an increase or decrease of the volume percentage, but based on the facts that a sufficient image density can be obtained when the volume percentage is in the range of from 10% to 45%, a lowering of image quality occurs when it is either less than 10% or more than 45%, and also neither sleeve ghost nor fogging occurs when it is within the above numerical range in which the image quality can be satisfactory. The former lowering of image quality is presumed to be due to negative properties, and the latter sleeve ghost or fogging is presumed to result from the fact that the magnetic particles become present in too large a quantity to open the sleeve surface and hence the quantity of toner fed from the sleeve surface greatly decreases.

If the volume percentage is less than 10%, line-image reproduction may become poor and image density may greatly decrease. On the other hand, if it is more than 45%, problems may arise such that the magnetic particles may scratch the surface of the photosensitive drum and unwanted transfer and fixing may be caused by magnetic particles adhering to drum surface as part of an image.

In instances in which the magnetic particles are present in a volume percentage close to 10%, there is a possibility (in a special environment) that uneven development partly occurs when a uniformly high-density image with a large area (a solid black image) is reproduced. Hence, it is preferable for the magnetic particles to be in a volume percentage not tending to cause such uneven development.

This preferable value is such that the magnetic particles have a volume percentage of not less than 15% with respect to the developing zone. The range thereby defined is a more preferable range. In instances in which the magnetic particles are present in a volume percentage close to 45%, there is a possibility (at the time of a high developing speed) that the feeding of toner from the sleeve surface is delayed at the circumference of the part with which an ear formed of magnetic particles comes into contact, to cause scaly uneven density when a solid black image is reproduced. A sure range within which this possibility can be avoided is such that the magnetic particles have a volume percentage of not more than 28%, which is a more preferable upper limit.

Figure 6:
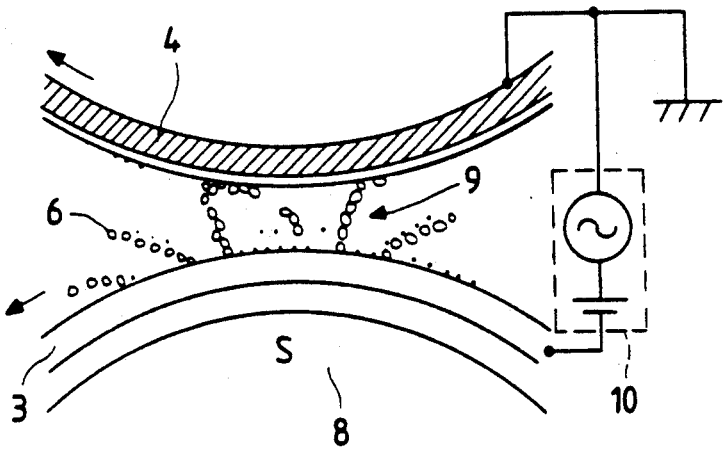
FIG. 6 is an enlarged view of the relationship between a photosensitive member and a sleeve, of the developing apparatus shown in FIG. 5.
Figure 7:
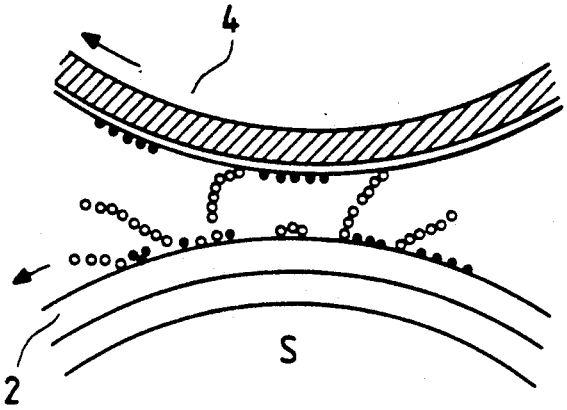
FIG. 7 is another enlarged view of the relationship between a photosensitive member and a sleeve, of the developing apparatus shown in FIG. 5.

So long as the volume percentage is in the range of from 10% to 45%, ears 9, as shown in FIG. 6, can be formed in such a state that they are scattered to a preferable extent, so that the toner present on both the sleeve 3 and the ears 9 can be sufficiently open to the photosensitive drum 4 and the toner on the sleeve can also fly and transfer through the alternating electric field, bringing about the state that almost all the toner can be consumed for development. This makes it possible to achieve a high development efficiency (a proportion of the toner consumed for development, to the toner present in the developing zone) and a high image density.

The volume percentage (%) of magnetic particles present in the developing zone can be determined according to the expression:

$$(M/h)\times(1/\rho)\times[C/(T+C)]\times\sigma\times 100$$

wherein M represents a coating weight (g/cm$^2$) of developer (a mixture, when no ear rises) per unit area of the sleeve, h represents a height (cm) of the space at the developing zone, $\rho$ represents a degree of true density (g/cm$^3$) of magnetic particles, C/(T+C) represents a weight proportion of magnetic particles in the developer present on the sleeve, and $\sigma$ represents a ratio of peripheral speed of the photosensitive drum to that of the sleeve (sleeve peripheral speed/photosensitive drum peripheral speed). In the developing zone in the above definition, the toner may preferably be in an amount of from 3 to 40% by weight based on the weight of the magnetic particles.

The magnetic particles used in the present invention may preferably have a narrow particle size distribution and be sharp-cut. A phenomenon in which the magnetic particles 6 adhere to the photosensitive drum 4 to adversely affect images or copying machines, i.e., what is called carrier adhesion, tends to occur when ultrafine magnetic particles are present. However, the magnetic particles used in the present invention are sharp-cut to have a 400 mesh or less fine-powder content of not more than 20% by weight, and hence the carrier adhesion can be preferably prevented. The fine-powder content may more preferably be not more than 15% by weight.

In the present invention, it is preferable to use magnetic particles having a uniform particle size, i.e., having a 250 mesh or more coarse-powder content of not more than 20% by weight, and more preferably not more than 10% by weight. This brings about an improved fluidity required as developer, so that toner and magnetic particles can be swiftly blended when the toner is fed. As a result, the distribution of toner charge also becomes sharp, so that a fog-free high-quality image can be obtained and also no toner scatter occurs. Moreover, because of an improvement in development efficiency and transfer efficiency, waste toner percentage decreases to promise an efficient toner consumption. On the other hand, magnetic particles with a uniform particle size have so good a packing structure that the carrier-wear is accelerated.

In the case of two-component developers, the toner particles each having a plurality of concavities on the particle surface may be used in combination, thereby making it possible to prepare a developer not tending to make the carrier worn out.

Figure 8:
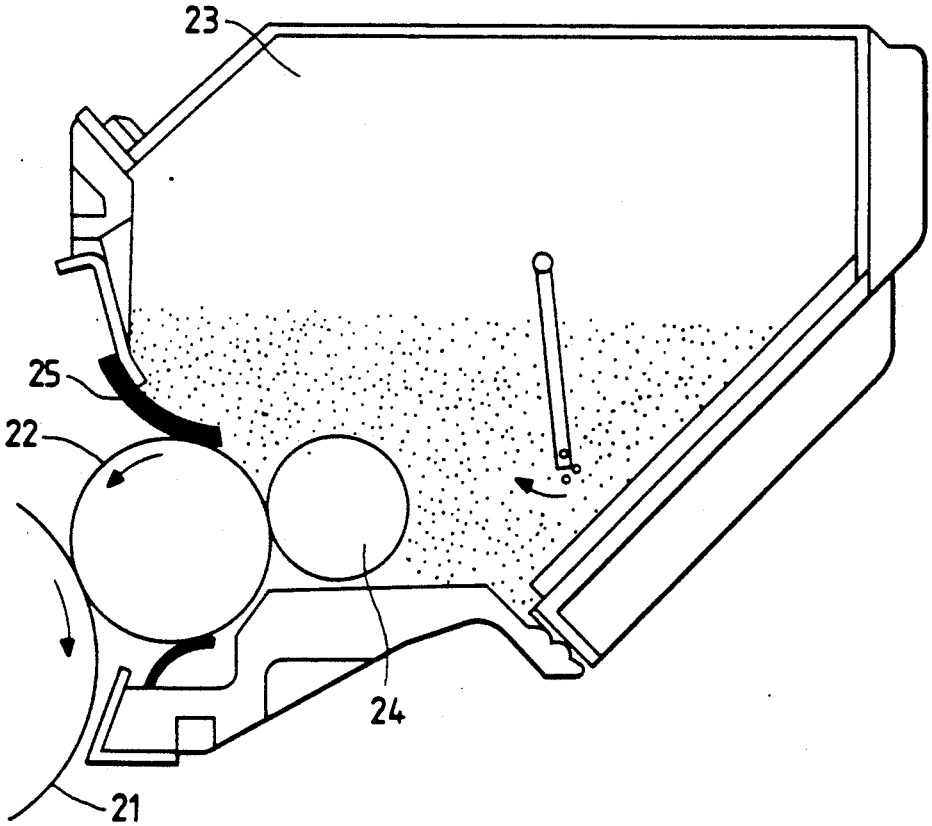
FIG. 8 schematically illustrates another example of a developing apparatus for carrying out the image forming method of the present invention.

An example of another image forming apparatus used in the present invention will be described below with reference to FIG. 8. In FIG. 8, reference numeral 21 denotes a latent image bearing member (a photosensitive drum), on which a latent image is formed through an electrophotographic process means or electrostatic recording means (not shown). Reference numeral 22 denotes a developer carrying member (a developer sleeve), comprised of a non-magnetic sleeve made of aluminum, stainless steel or the like. Such a developer carrying member 22 may be comprised of a crude pipe of aluminum or stainless steel used as it is, whose surface may preferably be uniformly roughed by spraying thereon glass beads or the like, mirror-finished, or coated with resin or the like. It is more preferable to use a developer carrying member having a surface layer comprised of a resin layer in which fine particles with a lubricity as exemplified by graphite particles have been dispersed. Developer is reserved in a hopper 23, and fed onto the developer carrying member 22 by means of a feed roller 24. The feed roller 24 is made of a foamed material such as polyurethane foam, and is rotated at a relative speed which is not zero in the normal or reverse direction with respect to the developer carrying member 22. This feed roller not only feeds the developer but also takes off developer (developer having not participated in development) remaining on the developer carrying member 22 after development.

The developer fed onto the developer carrying member 22 is coated in a uniform and thin layer by means of a developer coating blade 25. It is effective for the developer coating blade 25 and the developer carrying member 22 to be brought into contact at a contact pressure of from 3 to 250 g/cm, and preferably from 10 to 120 g/cm, as a linear pressure in the mother line direction of the sleeve. A contact pressure smaller than 3 g/cm tends to make it difficult for the developer to be uniformly coated and tends to result in a broad distribution of charges of the developer to cause fogging or toner scatter. A contact pressure larger than 250 g/cm is not preferable since the developer tends to undergo agglomeration of particles because of a large pressure applied to the toner and a deterioration of external additives of the developer. Such a contact pressure is also not preferable since a large torque must be applied in order to drive the developer carrying member 22.

As the developer coating blade 25, it is preferred to use a blade made of a material of a triboelectric series suited for the developer to be electrostatically charged in the desired polarity. For example, in order for the developer to be positively charged, silicone rubber, polyurethane, fluorine rubber or polychlorobutadiene rubber may be used and, in order for the developer to be negatively charged, styrene butadiene rubber or nylon may be used as the blade, whereby the triboelectric charge efficiency of the developer can be more improved. Silica or fine resin particles may also blended to control the properties of the blade that imparts triboelectric charge to the developer. Conductive powder such as carbon or titanium oxide may also be blended to provide the blade with an appropriate conductivity so that the developer can be prevented from being charged in excess.

Figure 9:
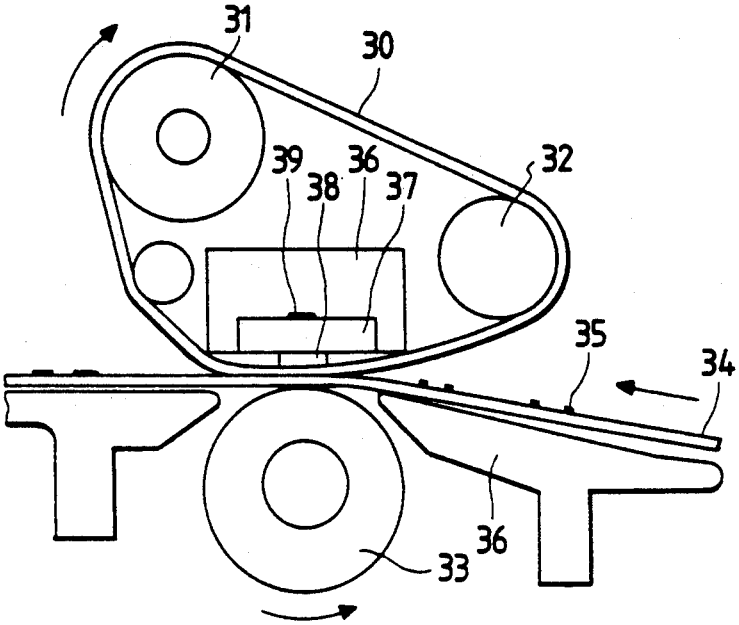
FIG. 9 schematically illustrates an example of a fixing apparatus for carrying out the heat fixing method of the present invention.
Figure 10:
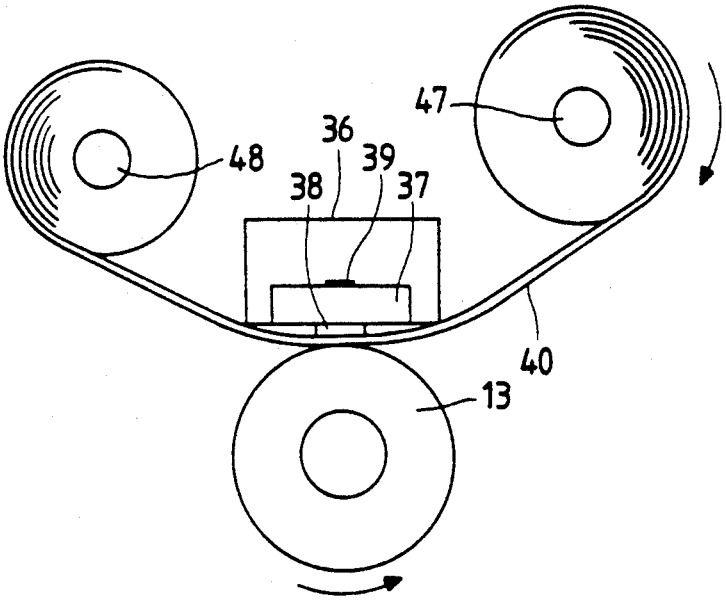
FIG. 10 schematically illustrates another example of the fixing apparatus for carrying out the heat fixing method of the present invention.

The toner heat fixing method according to the present invention can be carried out using a fixing device as shown in FIG. 9 or 10. In the fixing device shown in FIG. 9 or 10, a heater element has a smaller heat capacity than conventional heat rolls, and has a linear heating part. The heating part may preferably be made to have a maximum temperature of from 100° C. to 300° C. A film, which is interposed between the heater element and a pressure member, may preferably comprise a heat-resistant sheet of from 1 to 100 μm in thickness. The heat-resistant sheet that can be used therefor may include sheets of polymers having high heat-resistance, such as polyester, PET (polyethylene terephthalate), PFA (a tetrafluoroethylene/perfluoroalkyl vinyl ether copolymer), PTFE (polytetrafluoroethylene), polyimide and polyamide, sheets of metals such as aluminum, and laminate sheets comprised of a metal sheet and a polymer sheet.

In an embodiment of the film according to the present invention, any of these heat-resistant sheets have a release layer and/or a low-resistance layer. The film may preferably have, as surface properties of its surface coming into pressure contact with a recording medium, a critical surface tension of not more than 30 dyne/cm and a surface electrical resistance of not more than $10^{10}\Omega/cm^2$.

As the film applied to the present invention, it is more preferable to use a multi-layer coated film comprised of a heat-resistant material sheet comprising polyimide, polyetherimide, PES or PFA, with one side of which the heat element comes into pressure contact, and a low-resistance release layer provided at least on the side coming into contact with the image, comprising a binder resin such as PTFE or PFA having a critical surface tension of not more than 30 dyne/cm and to which a conductive material is added and dispersed to have a surface electrical resistance of not more than $10^{10}\Omega/cm^2$. The conductive material for controlling the surface electrical resistance, preferably used in the present invention, may include carbon black, graphite and inorganic oxides.

If the film used in the heat fixing method of the present invention has a critical surface tension more than 30 dyne/cm on the side coming into pressure contact with a recording medium, what is called offset phenomenon may seriously occur, which is a phenomenon in which toner adheres to the film surface. Similarly, if its surface electrical resistance is more than $10^{10}\Omega/cm^2$, a static offset phenomenon may seriously occur, which is a phenomenon in which toner electrostatically adhere to the film surface. The surface electrical resistance in the present invention can be measured according to the method as prescribed in JIS K6911.

The critical surface on the side coming into pressure contact with a recording medium, referred to in the present invention, can be determined by measuring contact angles $\theta$ which various organic liquids of hydrocarbon types and other types having different surface tension $\gamma$ make on the film surface, and performing Zisman plotting.

A preferred heat fixing unit or device used in the present invention will be described below with reference to the accompanying drawings. The following by no means limit the present invention. FIG. 9 illustrates a structure of such a heat fixing device.

Reference numeral 36 denotes a low heat capacitance linear heater element stationarily supported in the device. An example thereof comprises an alumina substrate 37 of 1.0 mm in thickness, 10 mm in width and 240 mm in longitudinal length and a resistance material 38 coated thereon in a width of 1.0 mm, which is electrified from the both ends in the longitudinal direction. The electricity is applied under variations of pulse widths of the pulses corresponding with the desired temperatures and energy emission quantities which are controlled by a temperature sensor 39, in the pulse-like waveform with a period of 20 msec of DC 100 V. The pulse widths range approximately from 0.5 msec to 5 msec. In contact with the heater element 36 the energy and temperature of which have been controlled in this way, a fixing film 30 moves in the direction of the arrow shown in the drawing. An example of this fixing film is an endless film comprised of heat-resistant sheet of 20 μm thick comprising, for example, polyimide or imide, with one side of which the heat element comes into pressure contact, and a release layer comprising PTFE to which carbon black is added as a conductive material, coated on the side coming into contact with the image to have a thickness of 10 μm. This film has a critical surface tension of 20 dyne/cm and a surface electrical resistance of $1\times10^6\Omega/cm^2$ on the side coming into pressure contact with a recording medium. In general, the total thickness of the film may preferably be less than 100 μm, and more preferably less than 40 μm.

The film is moved in the direction of the arrow in a wrinkle-free state by the action of the drive of, and tension between, a drive roller 31 and a follower roller 32. Reference numeral 33 denotes a pressure roller having on its surface an elastic layer of rubber with good release properties as exemplified by silicone rubber. This pressure roller is pressed against the heater element at a total pressure of 4 to 20 kg through the film interposed between them and is rotated in pressure contact with the film. Toner 35 having not been fixed on a transfer medium 34 is led to the fixing zone by means of an inlet guide 36. A fixed image is thus obtained by the heating described above.

The above has been described with reference to an embodiment in which the fixing film comprises the endless belt. As shown in FIG. 10, a sheet-feeding shaft 47 and a wind-up shaft 48 may also be used, and the fixing film may not be endless.

The image forming apparatus includes apparatus that form an image by the use of a toner, as exemplified by copying machines, printers, and facsimile apparatus, to all of which the present fixing device can be applied.

When the temperature detected by the temperature sensor 39 in the low heat capacitance linear heater element 36 is $T_1$, the surface temperature $T_2$ of the film 30 opposed to the resistance material 38 is about 10° to 30° C. lower than $T_1$. The surface temperature $T_3$ of the film on the part at which the film 30 is separated from the toner-fixed face is a temperature substantially equal to the above temperature $T_2$.

The particle size distribution in the present invention is measured in the following way.

A Coulter counter Type-II (manufactured by Coulter Electronics, Inc.) is used as a measuring device. An interface (manufactured by Nikkaki) that outputs number average distribution and volume average distribution and a personal computer CX-I (manufactured by Canon) are connected. As an electrolytic solution, an aqueous 1% NaCl solution is prepared using first-grade sodium chloride.

Measurement is carried out by adding as a dispersant 0.1 ml to 5 ml of a surface active agent, preferably an alkylbenzene sulfonate, to 100 ml to 150 ml of the above aqueous electrolytic solution, and further adding 0.5 mg to 50 mg of a sample to be measured. The electrolytic solution in which the sample has been suspended is subjected to dispersion for 1 minute to 3 minutes in an ultrasonic dispersion machine. The particle size distribution of particles of 2 μm to 40 μm is measured on the basis of the number by means of the above Coulter counter Type TA-II, using an aperture of 100 μm as its aperture, and then the volume average particle diameter and number average distribution are determined.

From these volume average particle diameter and number average distribution thus determined, weight average particle diameter (D4) is obtained.

The melting point of the low softening point material such as wax in the present invention is measured using a differential scanning calorimeter DSC-7 (manufactured by Perkin-Elmer Co.), at a rate of temperature rise of 10° C./min. In the DSC curve of the first temperature rise, the temperature corresponding to a maximum endothermic peak is regarded as the melting point of wax.

The melt characteristics of the toner in the present invention is measured using an overhead-type flow tester (Shimadzu Flow Tester CFT-500 Type). A sample in a weight of 1.0 g molded using a pressure molder is extruded from a nozzle of 1 mm in diameter and 1 mm in length under application of a load of 20 kgf using a plunger at temperatures rising at a rate of 5.0° C./min, during which the fall quantity of the plunger of the flow tester is measured. Here, the temperature at which the sample begins to flow out in the plunger fall quantity-temperature curve of the flow tester is regarded as the flow-out temperature.

The molecular weight in the present invention is measured by the method described below.

(1) Preparation of sample:

i) Standard sample:

Commercially available standard polystyrenes shown below are used as standard samples.

| Molecular weight | Manufacturer |
|---|---|
| $8.42 \times 10^6$ | Toyo Soda Manufacturing Co., Ltd. |
| $2.7 \times 10^6$ | Waters Co. |
| $1.2 \times 10^6$ | Waters Co. |
| $7.75 \times 10^5$ | Toyo Soda Manufacturing Co., Ltd. |
| $4.7 \times 10^5$ | Waters Co. |
| $2.0 \times 10^5$ | Waters Co. |
| $3.5 \times 10^4$ | Waters Co. |
| $1.5 \times 10^4$ | Waters Co. |
| $1.02 \times 10^4$ | Toyo Soda Manufacturing Co., Ltd. |
| $3.6 \times 10^3$ | Waters Co. |
| $2.35 \times 10^3$ | Waters Co. |

-continued

| Molecular weight | Manufacturer |
|---|---|
| $5.0 \times 10^2$ | Toyo Soda Manufacturing Co., Ltd. |

These twelve standard polystyrenes are divided into the following three groups.

(a) $8.42\times10^6$, $7.75\times10^5$, $3.5\times10^4$, $3.6\times10^3$ (b) $2.7\times10^6$, $4.7\times10^5$, $1.5\times10^4$, $2.35\times10^3$ (c) $1.2\times10^6$, $2.0\times10^5$, $1.02\times10^4$, $5.0\times10^2$ In a 30 ml sample bottle, four samples of each group are taken in an amount of about 3 mg (a quantity corresponding to a micro-spatula) for each, and 15 ml of THF is added thereto, which are then left to stand at room temperature for 4 hours (during which the bottle is vigorously shaken for one minute at intervals of 30 minutes). Subsequently, its contents are filtered using a membrane filter (regenerated cellulose, 0.45 μm; available from Toyo Roshi). Standard sample are thus prepared.

ii) Unknown:

Each sample weighed in an amount of 60 mg is put in a sample bottle, and 15 ml of THF is further added. Extraction is carried out in the following way: The bottle is left to stand at room temperature for 24 hours, while it is shaken at intervals of 30 minutes for the first 3 hours. Ultrasonic treatment is further applied for 15 minutes to sufficiently effect extraction. Insoluble matters are sedimented by centrifugal separation (5,000 rpm/20 min.). The resulting supernatant is filtered using a membrane filter (regenerated cellulose, 0.45 μm; available from Toyo Roshi). Sample are thus prepared.

(2) GPC:

Using 150C ALC/GPC (Waters Co.) as an apparatus, measured under the following conditions.

i) Solvent: THF (special grade; Kishida Chemical Co., Ltd.)

ii) Column: Combination of 4 columns, Showdex A-802, A-803, A-804, A-805 (Showa Denko K. K.)

iii) Temperature: 28° C.

iv) Flow velocity: 1.0 ml/min.

v) Pour: 0.5 ml vi) Detector: RI (3) GPC data processing:

i) Calibration curve:

(a) Chromatograms of each standard sample are taken, and the retention time of a peak is read. In instances in which several peaks are present, the time of the main peak is read.

(b) A calibration curve is prepared from the molecular weight of each standard sample and the peak retention time.

ii) Unknown:

Chromatograms of each unknown sample are taken, and its molecular weight is calculated form the peak retention time, using the calibration curve.

The particle size distribution of the magnetic particles is measured by the method described below.

1. About 100 g of a sample is weighed to a precision of 0.1 g.

2. As sieves, 100 mesh to 400 mesh standard sieves (hereinafter "sieve(s)") are used and are overlaid one another in order of 100 mesh, 145 mesh, 200 mesh, 250 mesh, 350 mesh and 400 mesh so that the 100 mesh sieve is uppermost. A dish is placed at the bottom. The sample is placed on the uppermost sieve, which is then covered.

3. The sample is sieved using a vibrator for 15 minutes at a horizontal swing number of 285+6 per minute and and an impulse number of 150±10 per minute.

4. After the sieving, iron powder on each sieve and the dish is weighed to a precision of 0.1 g.

5. Size is calculated to two decimals in weight percentage, and calculations are rounded to one decimal.

The frame of the sieves is 200 mm in inner diameter at the upper portion from the sieve surface and 45 mm in depth from the top to the sieve surface.

The total weight of the iron powder on each part must be more than 99% of the mass of the sample initially taken. The average particle diameter is calculated according to the following equation, on the basis of the above measured values of particle size distribution.

Average particle diameter (μm) = 1/100 ×
{(weight of sample remaining on 100 mesh sieve) × 140 +
(weight of sample remaining on 145 mesh sieve) × 122 +
(weight of sample remaining on 200 mesh sieve) × 90 +
(weight of sample remaining on 250 mesh sieve) × 68 +
(weight of sample remaining on 350 mesh sieve) × 52 +
(weight of sample remaining on 400 mesh sieve) × 38 +
(weight of sample having passed all sieves) × 17}

EXAMPLES

The present invention will be described below in greater detail by giving Examples.

Example 1

In 709 parts by weight of ion-exchanged water 451 parts by weight of an aqueous 0.1M $Ne_3PO_4$ solution was introduced, followed by heating to 60° C. and then stirring at 12,000 rpm using a TK-type homomixer (manufactured by Tokushu Kika Kogyo Co., Ltd.). To the resulting mixture, 67.7 parts by weight of an aqueous 1.0M $CaCl_2$ solution was added little by little to give a dispersion medium containing $Ca_3(PO_4)_2$.

| | (by weight) |
|---|---|
| Styrene | 170 parts |
| 2-Ethylhexyl acrylate | 30 parts |
| Paraffin wax (m.p.: 75° C.) | 60 parts |
| C.I. Pigment Blue 15:3 | 10 parts |
| Styrene/methacrylic acid/methyl methacrylate copolymer (Mw: 51,000; Mw/Mn: 3.0; acid value: 70) | 10 parts |
| Di-tert-butylsalicyclic acid metal compound | 3 parts |

Of the above materials, only C.I. Pigment Blue 15:3, di-tert-butylsalicylic acid metal compound and styrene were premixed using Ebara Milder (manufactured by Ebara Corporation). Next, all the above materials were heated to 60° C., followed by dissolution and dispersion to give a monomer mixture. While the monomer mixture thus prepared was maintained at 60° C. 10 parts by weight of a polymerization initiator dimethyl 2,2'-azobisisobutylate was added and dissolved. Thus a polymerizable monomer composition was prepared.

The above monomer composition was introduced in the dispersion medium prepared in a flask of the TK homomixer. Using the TK homomixer, made to have an atmosphere of nitrogen, stirring was carried out at 60° C. and at 10,000 rpm for 20 minutes to granulate the monomer composition. Thereafter, while stirring with a paddle agitating blade, reaction was carried out at 60° C. for 3 hours, and then at 80° C. for further 10 hours to complete polymerization.

After the polymerization was completed, the reaction system was cooled, and 27 parts by weight of 5N hydrochloric acid was added thereto, followed by further stirring with the paddle stirring blade for 2 hours. After the $Ca_3(PO_4)_2$ was thus dissolved, filtration and washing with water were repeated several times, and finally the product was dried. A toner produced by suspension polymerization was thus obtained.

The quantity of $Ca_3(PO_4)_2$ remaining on toner particle surfaces was determined by X-ray fluorometry to reveal that it was in a quantity of 0.1% by weight based on the toner.

Particle diameters of the resulting toner were measured with a Coulter counter to reveal that the toner had a weight average particle diameter of 8.2 μm and also had a sharp particle size distribution. Observation using an electron microscope confirmed that toner particles each had on their surfaces a plurality of concavities as shown in FIG. 1. The R/r of the toner particles was 1.10 and $L/2\pi r$ was 1.20. Cross sections of the toner particles were observed on a transmission electron microscope by a method using dyed ultra-thin sections. As a result, it was confirmed that the particles were each structurally separated into the surface layer mainly composed of styrene-acrylic resin and the center mainly composed of wax and that the phase mainly composed of wax was absent in the vicinity of each toner particle surface ranging from its surface to a depth 0.15 time a toner particle diameter and was in the range of from 10% to 45% of the cross-sectional area of the particle.

Based on 100 parts by weight of the toner obtained, 0.7 part by weight of hydrophobic silica having a specific surface area of 200 $m^2/g$ as measured by the BET method was externally added. Next, 7 parts by weight of the toner to which the hydrophobic silica had been externally added and 93 parts by weight of a Cu-Zn-Fe ferrite carrier having been surface-coated with a styrene/methyl methacrylate copolymer were blended to give a two-component developer.

Using this developer, images were reproduced on a modified machine of a color copier (CLC-500; manufactured by Canon Inc.), which was so modified that no silicone oil was applied to its fixing roller. Results obtained are shown in Table 1.

Examples 2 to 11 and 29

Various toners were prepared in the same manner as in Example 1 except that their formulations were changed as shown in Table 1. Their performances were evaluated. Results obtained are shown in Table 1.

Example 12

A toner was prepared in the same manner as in Example 1 except that the polymerization reaction temperature was set constant at 60° C. Results obtained are shown in Table 1.

Comparative Example 1

A toner was prepared in the same manner as in Example 1 except that the amount of paraffin wax was changed. Cross sections of toner particles were observed to reveal that the phase mainly composed of wax was more than 45% of the cross-sectional area of each toner particle. Results are shown in Table 2.

Comparative Examples 3 to 6, 8 and 9

Various toners were prepared according to the formulation shown in Table 2, and their performances were evaluated. Results obtained are shown in Table 2.

Comparative Example 7

A toner was prepared in the same manner as in Example 1 except that the amount of paraffin wax was changed. Cross sections of toner particles were observed to reveal that the phase mainly composed of wax was less than 10% of the cross-sectional area of each toner particle. Results are shown in Table 2.

Comparative Example 10

Toner particles were obtained in the same manner as in Example 1 except that the post-treatment making use of the aqueous HCl solution was not made. The quantity of $Ca_3(PO_4)_2$ remaining on toner particle surfaces was determined by X-ray fluorometry to reveal that it was in a quantity of 2.5% by weight based on the toner.

Using this toner, images were reproduced. As a result, the developer showed so extremely poor a fluidity in a high-temperature high-humidity environment that the image reproduction was stopped halfway. It also gave so low a quantity of triboelectricity in a low-temperature low-humidity environment that the images obtained were much fogged and coarse.

Example b 30

As a dispersion stabilizer 10 parts by weight of amino-modified colloidal silica (200 $m^2/g$) was used in place of $Ca_3(PO_4)_2$, and was added to 1,200 parts by weight of water to give an aqueous dispersion medium.

Suspension polymerization was carried out in the same manner as in Example 1 except that the aqueous dispersion medium thus obtained was used. After the colloidal silica was removed using an aqueous NaOH solution, filtration and washing with water were repeated several times followed by drying to give a toner. Results are shown in Table 2.

TABLE 1

| Example: | Polar resin Mw | Mw/Mn | Acid value (mgKOH/g) | Amount | Low softening point material |
|---|---|---|---|---|---|
| 1 | 51,000 | 3.0 | 70 | 5* | 30* |
| 2 | 102,000 | 4.5 | 50 | 5 | 20 |
| 3 | 102,000 | 7.0 | 50 | 5 | 20 |
| 4 | 102,000 | 4.5 | 25 | 5 | 20 |
| 5 | 102,000 | 4.5 | 90 | 5 | 20 |
| 6 | 20,000 | 2.0 | 50 | 5 | 20 |
| 7 | 151,000 | 4.5 | 50 | 5 | 20 |
| 8 | 51,000 | 3.0 | 70 | 5 | 8 |
| 9 | 51,000 | 3.0 | 70 | 5 | 40 |
| 10 | 51,000 | 3.0 | 70 | 0.5 | 30 |
| 11 | 51,000 | 3.0 | 70 | 10 | 30 |
| 12 | 51,000 | 3.0 | 70 | 5 | 30 |
| 29 | 102,000 | 10.5 | 50 | 5 | 20 |
| 30 | 51,000 | 3.0 | 70 | 5 | 30 |

| Example: | Presence of concavities | R/r | L/2πr | Particle size distribution | Blocking resistance | Fixing performance | Durability |
|---|---|---|---|---|---|---|---|
| 1 | A | 1.10 | 1.20 | A | AA | A | AA |
| 2 | A | 1.05 | 1.18 | A | AA | A | AA |
| 3 | A | 1.08 | 1.19 | A | A | A | A |
| 4 | B | 1.03 | 1.03 | A | A | A | B |
| 5 | A | 1.18 | 1.80 | B | AA | A | A |
| 6 | B | 1.06 | 1.10 | B | AA | A | B |
| 7 | A | 1.08 | 1.20 | B | AA | A | A |
| 8 | A | 1.09 | 1.15 | A | AA | B | AA |
| 9 | A | 1.10 | 1.20 | A | A | A | A |
| 10 | B | 1.05 | 1.11 | A | A | A | B |
| 11 | A | 1.11 | 1.21 | B | AA | A | A |
| 12 | B | 1.04 | 1.09 | A | A | A | B |
| 29 | A | 1.08 | 1.18 | B | B | A | B |
| 30 | B | 1.01 | 1.0 | A | B | A | B |

*part(s) by weight

Evaluation:

Presence of concavities:
(Average number of concavities per toner particle in a visual field)
A: 5 or more, B: 2 to 4, C: 0 to 1

Particle size distribution:
A: Very sharp distribution
B: No difficulty in practical use
C: Requires classification Blocking resistance:
AA: 50° C., 7 days or more all right
A: 50° C., 5 days or more all right
B: 50° C., 3 days or more all right
C: 50° C., less than 3 days Fixing performance:
A: Very good
B: No difficulty in practical use
C: A difficulty in practical use Durability:
AA: Very good
A: Good
B: No difficulty in practical use
C: A difficulty in practical use

TABLE 2

| Comparative Example: | Polar resin Mw | Mw/Mn | Acid value (mgKOH/g) | Amount | Low softening point material |
|---|---|---|---|---|---|
| 1 | 51,000 | 3.0 | 70 | 5* | 60* |
| 3 | 102,000 | 4.5 | 10 | 5 | 20 |
| 4 | 102,000 | 4.5 | 120 | 5 | 20 |
| 5 | 8,000 | 1.5 | 50 | 5 | 20 |
| 6 | 300,000 | 4.3 | 50 | 5 | 20 |
| 7 | 51,000 | 3.0 | 70 | 5 | 3 |
| 8 | 51.000 | 3.0 | 70 | 0.01 | 30 |
| 9 | 51,000 | 3.0 | 70 | 20 | 30 |
| 10 | 51,000 | 3.0 | 70 | 5 | 30 |

| Comparative Example: | Presence of concavities | R/r | L/2πr | Particle size distribution | Blocking resistance | Fixing performance | Durability |
|---|---|---|---|---|---|---|---|
| 1 | A | 1.10 | 1.20 | B | C | A | B |
| 3 | C | 1.00 | 1.00 | A | AA | A | C |
| 4 | C | 1.25 | 2.03 | C | — | — | — |
| 5 | C | 1.00 | 1.00 | A | AA | A | C |
| 6 | C | 1.21 | 2.01 | C | — | — | — |
| 7 | A | 1.09 | 1.19 | A | AA | C | AA |
| 8 | C | 1.00 | 1.00 | B | B | A | C |
| 9 | C | 1.22 | 2.02 | C | — | — | — |
| 10 | A | 1.10 | 1.20 | A | AA | A | C |

*part(s) by weight
Evaluation: The same manner as Table 1.

EXAMPLE 13

In 709 g of ion-exchanged water, 451 g of an aqueous 0.1M $Na_3PO_4$ solution was introduced, followed by heating to 60° C. and then stirring at 12,000 rpm using a TK-type homomixer (manufactured by Tokushu Kika Kogyo Co., Ltd.). To the resulting mixture, 67.7 g of an aqueous 1.0M $CaCl_2$ solution was added little by little to give a dispersion medium containing $Ca_3(PO_4)_2$.

| | |
|---|---|
| Styrene | 170 g |
| 2-Ethylhexyl acrylate | 30 g |
| Paraffin wax (m.p.: 75° C.) | 60 g |
| C.I. Pigment Blue 15:3 | 10 g |
| Styrene/methacrylic acid/methyl methacrylate copolymer (Mw: 50,000; Mw/Mn: 2.5; acid value: 50) | 5 g |
| Di-tert-butylsalicylic acid metal compound | 3 g |

Of the above materials, only C.I. Pigment Blue 15:3, di-tert-butylsalicylic acid metal compound and styrene were premixed using Ebara Milder (manufactured by Ebara Corporation). Next, all the above materials were heated to 60° C., followed by dissolution and dispersion to give a monomer mixture. While the monomer mixture thus prepared was maintained at 60° C., 10 g of a polymerization initiator dimethyl 2,2'-azobisisobutylate was added and dissolved. Thus a polymerizable monomer composition was prepared.

The resulting monomer composition was introduced in the dispersion medium prepared in a 2 lit. flask of the TK homomixer. Using the TK homomixer, made to have an atmosphere of nitrogen, stirring was carried out at 60° C. and at 10,000 rpm for 20 minutes to granulate the monomer composition. Thereafter, while stirring with a paddle agitating blade, reaction was carried out at 60° C. for 3 hours, and then at 80° C. for further 10 hours to complete polymerization.

After the polymerization was completed, the reaction system was cooled, and 27 g of 5N hydrochloric acid was added thereto, followed by further stirring with the paddle stirring blade for 2 hours. After the $Ca_3(PO_4)_2$ was thus dissolved, filtration and washing with water were repeated several times, and finally the product was dried. A toner produced by suspension polymerization was thus obtained.

The quantity of $Ca_3(PO_4)_2$ remaining on toner particle surfaces was determined by X-ray fluorometry to reveal that it was in a quantity of 0.1% by weight based on the toner.

Particle diameters of the resulting toner were measured with a Coulter counter to reveal that the toner had a weight average particle diameter of 8.2 μm and a sharp particle size distribution. Observation using an electron microscope confirmed that toner particles each had on their surfaces a plurality of concavities as shown in FIG. 1. The R/r of the toner particles was 1.07 and $L/2\pi r$ was 1.07. Cross sections of the toner particles were observed on a transmission electron microscope by a method using dyed ultra-thin sections. As a result, it was confirmed that the particles were each structurally separated into the surface layer mainly composed of styrene-acrylic resin and the center mainly composed of wax and that the phase mainly composed of wax was absent in the vicinity of each toner particle surface ranging from its surface to a depth 0.15 time a toner particle diameter.

Based on 100 parts by weight of the toner obtained, 0.7 part by weight of hydrophobic silica having a specific surface area of 200 $m^2/g$ as measured by the BET method was externally added. Next, 7 parts by weight of the toner to which the hydrophobic silica had been externally added and 93 parts by weight of a Cu-Zn-Fe ferrite carrier having been surface-coated with a styrene/methyl methacrylate copolymer were blended to give a two-component developer.

Using this developer, images were reproduced on a color copier (CLC-500; manufactured by Canon Inc.).

Developing conditions were as follows:

Development contrast of 430 V in an environment of 20° C./10% RH

Development contrast of 320 V in an environment of 23° C./65% RH

Development contrast of 270 V in an environment of 30° C./80% RH

Under the respective conditions, images were reproduced on 10,000 copy sheets.

As a result, no faulty cleaning occurred at all, and image densities were as very stable as from 1.4 to 1.6, where coarseness-free very sharp images were obtained. In any environments, the quantity of triboelectricity little changed before and after running, showing that the toner had a superior charge stability.

Comparative Example 12

Toner particles were obtained in the same manner as in Example 13 except that the treatment making use of HCl was not made. The quantity of $Ca_3(PO_4)_2$ remaining on toner particle surfaces was determined by X-ray fluorometry to reveal that it was in a quantity of 2.5% by weight based on the toner.

Using this toner, images were reproduced. As a result, the developer showed so extremely poor a fluidity in a high-temperature high-humidity environment that the image reproduction was stopped halfway. It also gave so low a quantity of triboelectricity in a low-temperature low-humidity environment that the toner images obtained were much fogged and coarse.

Comparative Example 13

A toner was obtained in the same manner as in Example 13 except that the 5N HCl was added in an amount of 13.5 g, the stirring with the paddle stirring blade was carried out for 24 hours to dissolve the $Ca_3(PO_4)_2$. The quantity of $Ca_3(PO_4)_2$ remaining on toner particle surfaces was determined by X-ray fluorometry to reveal that it was in a quantity of 0.33% by weight based on the toner.

Using this toner, images were reproduced. As a result, although there was no particular problem in the low-temperature low-humidity environment, toner scatter gradually began to occur in the running in the high-temperature high-humidity environment, and the images obtained were much fogged and coarse.

Comparative Example 14

A cyan toner with a weight average particle diameter of 8.6 μm was obtained in the same manner as in Example 13 except that the polar resin used was replaced with a styrene/butyl acrylate copolymer (Mw: 30,000; Mw/Mn: 3.8 acid value; 0.2). The quantity of $Ca_3(PO_4)_2$ remaining on toner particle surfaces was determined to reveal that it was in a quantity of 0.12 % by weight based on the toner.

The resulting toner had no unevenness on its particle surfaces and was a true-spherical toner. Using this toner, a running test was made to find that a decrease in density greatly occurred and also the images obtained were much fogged and coarse.

Comparative Example 15

A cyan toner with a weight average particle diameter of 8.3 μm was obtained in the same manner as in Example 13 except that the polar resin was not used.

A developer was prepared in the same way, and images were reproduced. As a result, image density decreased as the running proceeds, and faulty cleaning occurred after running on about 3,000 copy sheets. The toner at the start of running was observed by FE-SEM (field emission scanning electron microscopy) to find that the toner had no surface concavities and was a true-spherical toner.

Comparative Example 16

Polymerization was carried out in the same manner as in Example 13 except that the $Ca_3(PO_4)_2$ was replaced with polyvinyl alcohol as a dispersant. After cooling, washing with water was repeated several times to remove the polyvinyl alcohol.

The toner obtained had a weight average particle diameter of 8.2 μm, but had a reasonably broad particle size distribution. Moreover, it was impossible for this toner to have attained the wax-encapsulated double-layer structure characteristic of the present invention.

This was presumed due to the fact that the stability of interfaces between toner particles decreased compared with that of toner particles provided with $Ca_3(PO_4)_2$, resulting in a lowering of granulation properties.

The above toner showed a poor blocking resistance and an inferior storage stability.

Example 14

A cyan toner with a weigh average particle diameter of 8.0 μm was obtained in the same manner as in Example 13 except that the polar resin used therein was replaced with a styrene/methacrylic acid/methyl acrylate copolymer having an Mw of 100,000, an Mw/Mn of 3.5 and an acid value of 70. The R/r of the toner particles was 1.08 and $L/2\pi r$ was 1.08. The quantity of $Ca_3(PO_4)_2$ remaining on toner particle surfaces was determined to reveal that it was in a quantity of 0.06 % by weight based on the toner.

A developer was prepared in the same manner as in Example 13, and a running test was made on 10,000 copy sheets. As a result, always stable images were obtained without variations in image density. No faulty cleaning was also seen. The toner after running was observed by FE-SEM to confirm that the toner particles each had a plurality of substantially the same concavities as those of the toner before running and a silica adhered the surface of the toner.

Example 15

In Example 13, 645 g of an aqueous 0.1M $Na_3PO_4$ solution was introduced in 498 g of ion-exchanged water, followed by heating to 80° C. and then stirring at 10,000 rpm using a TK-type homomixer (manufactured by Tokushu Kika Kogyo Co., Ltd.). To the resulting mixture, 96.7 of an aqueous 1.0M $CaCl_2$ solution was added little by little to give a dispersion medium containing $Ca_3(PO_4)_2$.

The step of polymerization was completed in the same manner as in Example 13, adding the same polymerizable monomer composition as used therein, except that the granulation and polymerization were carried out at 80° C. After cooling, 38.5 g of 5N hydrochloric acid was added to remove $Ca_3(PO_4)_2$. A toner was thus obtained.

Particle diameters of the resulting toner were measured with a Coulter counter to reveal that the toner had a weight average particle diameter of 5.5 μm and a sharp particle size distribution. The R/r of the toner particles was 1.06 and $L/2\pi r$ was 1.09. The quantity of $Ca_3(PO_4)_2$ remaining on toner particle surfaces was determined by X-ray fluorometry to reveal that it was in a quantity of 0.08% by weight based on the toner.

Example 16

A developer was prepared in the same manner as in Example 13 except that the amounts of silica and carrier were changed to 1.0 part by weight and 94 parts by weight, respectively.

Images were reproduced under development contrast made a little stronger. As a result, images with superior fine-line reproduction and highlight gradation were obtained. In particular, charge was stable also in the high-temperature high-humidity environment. No problem occurred also in an image reproduction test made after the developer had been left for a long period of time.

Example 17

An aqueous 0.1M $Na_3PO_4$ solution and an aqueous 1M $CaCl_2$ solution were prepared. In a 2 lit. flask of a TK-type homomixer (manufactured by Tokushu Kika Kogyo Co., Ltd.), 451 g of the aqueous 0.1M $Na_3PO_4$ solution and 709 g of ion-exchanged water were introduced, followed by stirring at 12,000 rpm. To the resulting mixture, 67.7 g of an aqueous 1M $CaCl_2$ solution was added little by little while the above stirring was carried out using the homomixer, heated to a temperature of 60° C., to give an aqueous dispersion medium containing $Ca_3(PO_4)_2$.

| | |
|---|---|
| Styrene | 180 g |
| 2-Ethylhexyl acrylate | 20 g |
| Paraffin wax (m.p.: 75° C.) | 60 g |
| C.I. Pigment Blue 15:3 | 10 g |
| Sytrene/methacrylic acid/methyl methacrylate copolymer | 5 g |
| polymer (Mw: 48,000; Mw/Mn: 3.1; acid value: 50) | |
| Di-tert-butylsalicylic acid metal compound | 2 g |

Of the above materials, only C.I. Pigment Blue 15:3, di-tert-butylsalicylic acid metal compound and styrene were premixed using Ebara Milder (manufactured by Ebara Corporation). Next, all the above materials were heated to 60° C., followed by dissolution and dispersion to give a monomer mixture. While the monomer mixture thus prepared was maintained at 50° C., 10 g of 2,2'-azobis(2,4-dimethylvaleronitrile) and 1 g of dimethyl 2,2'-azobisisobutylate as polymerization initiators were added and dissolved. Thus a polymerizable monomer composition was prepared.

The resulting monomer composition was introduced in the aqueous dispersion medium prepared in a 2 lit. flask of the TK homomixer. Using the TK homomixer, made to have an atmosphere of nitrogen, stirring was carried out at 60° C. and at 10,000 rpm for 20 minutes to granulate the monomer composition. Thereafter, while stirring with a paddle agitating blade, reaction was carried out at 60° C. for 3 hours, and then at 80° C. for further 10 hours to complete polymerization.

After the polymerization was completed, the reaction system was cooled, and hydrochloric acid was added to dissolve the $Ca_3(PO_4)_2$, followed by filtration, washing with water and then drying to give a toner.

Particle diameters of the resulting toner were measured with a Coulter counter to reveal that the toner had a weight average particle diameter of 8.6 μm and a sharp particle size distribution. Observation using an electron microscope confirmed that toner particles each had on their surfaces a plurality of concavities. The R/r of the toner particles was 1.07 and $L/2\pi r$ was 1.05.

Cross sections of the toner particles were observed on a transmission electron microscope by a method using dyed ultra-thin sections. As a result, it was confirmed that the particles were each structurally separated into the surface layer mainly composed of styrene-acrylic resin and the center mainly composed of wax and that the phase mainly composed of wax was absent in the vicinity of each toner particle surface ranging from its surface to a depth 0.15 time a toner particle diameter.

Based on 100 parts by weight of the toner obtained, 0.7 part by weight of hydrophobic silica having a specific surface area of 200 $m^2/g$ as measured by the BET method was externally added.

Next, 7 parts by weight of the toner to which the hydrophobic silica had been externally added and 93 parts by weight of a ferrite carrier having been surface-coated with an acrylic resin, having an average particle diameter of 50 μm, containing fine powder of 400 mesh or less in an amount of 12% by weight and containing coarse powder of 250 mesh or more in an amount of 3% by weight were blended to give a developer.

Using the developer thus obtained, a 20,000 sheet running test was made using a color copier CLO-500, manufactured by Canon Inc. As a result, images having image density of 1.4 or higher, free from fogging and having very high resolution were stably obtained. Electron-microscopic observation of surfaces of carrier particles after the running test revealed that the carrier-spent was on the level of no problem.

EXAMPLE 18

An aqueous 0.1M $Na_3PO_4$ solution and an aqueous 1M $CaCl_2$ solution were prepared. In a 2 lit. flask of a TK-type homomixer (manufactured by Tokushu Kika Kogyo Co., Ltd.), 451 g of the aqueous 0.1M $Na_3PO_4$ solution and 709 g of ion-exchanged water were introduced, followed by stirring at 12,000 rpm. To the resulting mixture, 67.7 g of an aqueous 1M $CaCl_2$ solution was added little by little while the above stirring was carried out using the homomixer, heated to a temperature of 60° C., to give an aqueous dispersion medium containing $Ca_3(PO_4)_2$.

| | |
|---|---|
| Styrene | 175 g |
| 2-Ethylhexyl acrylate | 25 g |
| Paraffin wax (m.p.: 75° C.) | 60 g |
| C.I. Pigment Blue 15:3 | 10 g |
| Styrene/methacrylic acid/methyl methacrylate copolymer (Mw: 58,000; Mw/Mn: 3.1; acid value: 70) | 5 g |
| Di-tert-butylsalicylic acid metal compound | 3 g |

Of the above materials, only C.I. Pigment Blue 15:3, di-tert-butylsalicylic acid metal compound and styrene were premixed using Ebara Milder (manufactured by Ebara Corporation). Next, all the above materials were heated to 60° C., followed by dissolution and dispersion to give a monomer mixture. While the monomer mixture thus prepared was maintained at 60° C., 10 g of 2,2'-azobis(2,4-dimethylvaleronitrile) and 1 g of dimethyl 2,2'-azobisisobutylate as polymerization initiators were added and dissolved. Thus a polymerizable monomer composition was prepared.

The resulting monomer composition was introduced in the aqueous dispersion medium prepared in a 2 lit. flask of the TK homomixer. Using the TK homomixer, made to have an atmosphere of nitrogen, stirring was carried out at 60° C. and at 10,000 rpm for 20 minutes to granulate the monomer composition. Thereafter, while stirring with a paddle agitating blade, reaction was carried out at 60° C. for 3 hours, and then at 80° C. for further 10 hours to complete polymerization.

After the polymerization was completed, the reaction system was cooled, and hydrochloric acid was added to dissolve the $Ca_3(PO_4)_2$, followed by filtration, washing with water and then drying to give a toner.

Particle diameters of the resulting toner were measured with a Coulter counter to reveal that the toner had a weight average particle diameter of 8.5 μm and a sharp particle size distribution. Observation using an electron microscope confirmed that toner particles each had on their surfaces a plurality of concavities. The R/r of the toner particles was 1.07 and $L/2\pi r$ was 1.05.

Cross sections of the toner particles were observed on a transmission electron microscope by a method using dyed ultra-thin sections. As a result, it was confirmed that the particles were each structurally separated into the surface layer mainly composed of styrene-acrylic resin and the center mainly composed of wax and that the phase mainly composed of wax was absent in the vicinity of each toner particle surface ranging from its surface to a depth 0.15 time a toner particle diameter.

Based on 100 parts by weight of the toner obtained, 0.7 part by weight of hydrophobic silica having a specific surface area of 200 $m^2/g$ as measured by the BET method was externally added. Next, 7 parts by weight of this toner and 93 parts by weight of a ferrite carrier having been surface-coated with an acrylic resin were blended to give a developer.

Using this developer, images were reproduced on a modified machine of a full-color copier (trade name: Color Laser Copia; manufactured by Canon Inc.). On the surface of the photosensitive member 4 set opposingly to the developing sleeve 3, a latent image with a dark portion (a laser power minimum) of −550 V and a light portion (a laser power maximum) a latent image portion) of −100 V was formed as an electrostatic latent image. The space between the surfaces of the sleeve and photosensitive member was set to be 400 μm. Here, developing was carried out under conditions of −420 V as DC component of the bias power source, 1.8 KHz as a frequency of AC component and 1.8 KVpp applied as a peak-to-peak voltage. At this time the volume percentage of the magnetic particles in the developing zone was 20%.

A 20,000 sheet running test was made under conditions as described above. As a result, images having image density of 1.4 or higher, free from fogging and having very high resolution were stably obtained. No faulty cleaning occurred and any toner scatter in the copier was not particularly seen.

Example 19

A toner with a weight average particle diameter of 8.8 μm was prepared in the same manner as in Example 17 except that the monomer mixture was formulated as follows:

| | |
|---|---|
| Styrene | 180 g |
| 2-Ethylhexyl acrylate | 20 g |
| Paraffin wax (m.p.: 65° C.) | 80 g |
| C.I. Pigment Blue 15:3 | 10 g |
| Styrene/methacrylic acid/methyl methacrylate copolymer (Mw: 61,000; Mw/Mn: 6.6; acid value: 70) | 5 g |
| Di-tert-butylsalicylic acid metal compound | 3 g |

Particles of the resulting toner were confirmed each to have on their surfaces a plurality of concavities. The R/r of the toner particles was 1.04 and $L/2\pi r$ was 1.03. Cross sections of the toner particles were also observed to confirmed that the phase mainly composed of wax was absent in the vicinity of each toner particle surface ranging from its surface to a depth 0.15 time a toner particle diameter.

After a hydrophobic silica was externally added to this toner in the same manner as in Example 17, 5 parts by weight of this toner and 95 parts by weight of a ferrite carrier having been surface-coated with an acrylic resin, having an average particle diameter of 45 μm, containing fine powder of 400 mesh or less in an amount of 16% by weight and containing coarse powder of 250 mesh or more in an amount of 1.0% by weight were blended to give a developer.

Using the developer thus obtained, a running test was made in the same manner as in Example 17. As a result, images without any particular fogging and with very high resolution were stably obtained. Observation of surfaces of carrier particles revealed that the carrier-spent was a little poorer than that in Example 17, but on the level tolerable in practical use.

Example 20

A toner with a weight average particle diameter of 8.2 μm was prepared in the same manner as in Example 18 except that the monomer mixture was formulated as follows:

| | |
|---|---|
| Styrene | 180 g |
| 2-Ethylhexyl acrylate | 20 g |
| Paraffin wax (m.p.: 65° C.) | 80 g |
| C.I. Pigment Blue 15:3 | 10 g |
| Sytrene/methacrylic acid/methyl methacrylate copolymer (Mw: 62,000; Mw/Mn: 5.5; acid value: 70) | 5 g |
| Di-tert-butylsalicylic acid metal compound | 3 g |

Particles of the resulting toner were confirmed each to have on their surfaces a plurality of concavities. The R/r of the toner particles was 1.04 and $L/2\pi r$ was 1.04. Cross sections of the toner particles were also observed to confirmed that the phase mainly composed of wax was absent in the vicinity of each toner particle surface ranging from its surface to a depth 0.15 time a toner particle diameter.

After a hydrophobic silica was externally added to this toner in the same manner as in Example 17, the same procedure as in Example 18 was repeated to give a developer.

Using the developer thus obtained, a 20,000 sheet running test was made in the same manner as in Example 18. As a result, images having image density of 1.4 or higher, free from fogging and having very high resolution were stably obtained.

Comparative Example 16

To 1,200 ml of ion-exchanged water, 0.25 g of γ-aminopropyltrimethoxysilane was added and 5 g of hydrophilic colloidal silica was further added. These were heated to 60° C. and dispersed with stirring at 10,000 rpm for 15 minutes using a TK-type homomixer. An aqueous 1/10N HCl solution was further added to adjust the pH in the system to 6. Thus an aqueous dispersion medium was prepared.

| | |
|---|---|
| Styrene | 180 g |
| 2-Ethylhexyl acrylate | 20 g |
| Paraffin wax (m.p.: 75° C.) | 80 g |
| C.I. Pigment Blue 15:3 | 10 g |
| Sytrene/methacrylic acid/methyl methacrylate copolymer (Mw: 55,000; Mw/Mn: 10.2; acid value: 70) | 2 g |
| Di-tert-butylsalicylic acid metal compound | 3 g |

The above materials were heated to 60° C. in a container, followed by dissolution and dispersion to give a monomer mixture. While the monomer mixture thus prepared was maintained at 60° C., 1 g of dimethyl 2,2'-azobisisobutylate and 10 g of 2,2'-azobis(2,4-dimethylvaleronitrile) as polymerization initiators were added and dissolved. Thus a polymerizable monomer composition was prepared.

The resulting monomer composition was introduced in a 2 lit. flask holding the aqueous dispersion medium previously prepared. Using the TK homomixer, stirring was carried out in an atmosphere of nitrogen, at 60° C. and at 9,000 rpm for 60 minutes to granulate the monomer composition. Thereafter, while stirring with a paddle agitating blade, polymerization was carried out at 60° C. for 20 hours. After the polymerization was completed, the reaction system was cooled, and NaOH was added to dissolve the colloidal silica, followed by filtration, washing with water and then drying to give a toner.

The toner thus obtained had a weight average particle diameter of 8.9 μm and a sharp particle size distribution. It was also confirmed that toner particles each had been made a little amorphous. The R/r of the toner particles was 1.02 and $L/2\pi r$ was 1.03. However, observation of cross sections of the toner particles revealed that the phase mainly composed of wax was present also in the vicinity of each toner particle surface layer and that, of ten particles of wax, one was present in the surface region with a depth smaller than 0.15 time a toner particle diameter and also the boundary between phases was not so distinct as that of Example 18.

After a hydrophobic silica was externally added to this toner in the same manner as in Example 18, the same procedure as in Example 18 was repeated to give a developer. Using the developer thus obtained, a running test was made in the same manner as in Example 18. As a result, the inside of the machine became soiled because of toner scatter as the running proceeds and also the image density became so high that it was difficult to make control. At this time the surfaces of carrier particles and the surface of the developer sleeve were observed to find that they were seriously soiled with toner compositions.

Example 21

A toner with a weight average particle diameter of 8.7 μm was prepared in the same manner as in Example 17 except that the monomer mixture was formulated as follows:

| | |
|---|---|
| Styrene | 175 g |
| 2-Ethylhexyl acrylate | 25 g |
| Paraffin wax (m.p.: 75° C.) | 10 g |
| C.I. Pigment Blue 15:3 | 10 g |
| Sytrene/methacrylic acid/methyl methacrylate copolymer (Mw: 45,000; Mw/Mn: 3.0; acid value: 50) | 5 g |
| Di-tert-butylsalicylic acid metal compound | 3 g |

Particles of the resulting toner were confirmed each to have on their surfaces a plurality of concavities. The R/r of the toner particles was 1.03 and $L/2\pi r$ was 1.03. Cross sections of the toner particles were also observed to confirmed that the phase mainly composed of wax was absent in the vicinity of each toner particle surface ranging from its surface to a depth 0.15 time a toner particle diameter.

After a hydrophobic silica was externally added to this toner in the same manner as in Example 17, the resulting toner and the same carrier as used in Example 17 were blended to give a developer. Using the developer thus obtained, a running test was made in the same manner as in Example 17. As a result, images free from fogging and with very high resolution were stably obtained. Observation of surfaces of carrier particles revealed that the carrier-spent was on the same level as in Example 18, which was tolerable in practical use.

Comparative Example 17

To 1,200 ml of ion-exchanged water, 0.25 g of γ-aminopropyltrimethoxysilane was added and 5 g of hydrophilic colloidal silica was further added. These were heated to 60° C. and dispersed with stirring at 10,000 rpm for 15 minutes using a TK-type homomixer. An aqueous 1/10N HCl solution was further added to adjust the pH in the system to 6. Thus an aqueous dispersion medium was prepared.

| | |
|---|---|
| Styrene | 180 g |
| 2-Ethylhexyl acrylate | 20 g |
| Paraffin wax (m.p.: 75° C.) | 80 g |
| C.I. Pigment Blue 15:3 | 10 g |
| Sytrene/methacrylic acid/methyl methacrylate copolymer (Mw: 61,000; Mw/Mn: 10.2; acid value: 70) | 2 g |
| Di-tert-butylsalicylic acid metal compound | 3 g |

The above materials were heated to 60° C. in a container, followed by dissolution and dispersion to give a monomer mixture. While the monomer mixture thus prepared was maintained at 60° C., 1 g of dimethyl 2,2'-azobisisobutylate and 10 g of 2,2'-azobis(2,4-dimethylvaleronitrile) as polymerization initiators were added and dissolved. Thus a polymerizable monomer composition was prepared.

The resulting monomer composition was introduced in a 2 lit. flask holding the aqueous dispersion medium previously prepared. Using the TK homomixer, stirring was carried out in an atmosphere of nitrogen, at 60° C. and at 9,000 rpm for 60 minutes to granulate the monomer composition. Thereafter, while stirring with a paddle agitating blade, polymerization was carried out at 60° C. for 20 hours. After the polymerization was completed, the reaction system was cooled, and NaOH was added to dissolve the colloidal silica, followed by filtration, washing with water and then drying to give a toner.

The toner thus obtained had a weight average particle diameter of 9.2 μm and a sharp particle size distribution. It was also confirmed that toner particles each had been made a little amorphous. The R/r of the toner particles was 1.02 and $L/2\pi r$ was 1.03. However, observation of cross sections of the toner particles revealed that the phase mainly composed of wax was present also in the vicinity of each toner particle surface layer and that, of twenty particles of wax, three were present in the surface region with a depth smaller than 0.15 time a toner particle diameter and also the boundary between phases was not so distinct as that of Example 17.

After a hydrophobic silica was externally added to this toner in the same manner as in Example 17, the resulting toner and the same carrier as used in Example 17 were blended to give a developer. Using the developer thus obtained, a running test was made in the same manner as in Example 17. As a result, the inside of the machine became soiled because of toner scatter as the running proceeds, so that images became adversely affected, and accordingly the running test was stopped on 8,000 sheet coying. At this time, carrier particles surfaces were observed to confirm that the carrier-spent had greatly occurred.

Example 22

A toner with a weight average particle diameter of 8.3 μm was prepared in the same manner as in Example 18 except that the monomer mixture was formulated as follows:

| | |
|---|---|
| Styrene | 175 g |
| 2-Ethylhexyl acrylate | 25 g |
| Paraffin wax (m.p.: 75° C.) | 10 g |
| C.I. Pigment Blue 15:3 | 10 g |
| Styrene/methacrylic acid/methyl methacrylate copolymer (Mw: 57,000; Mw/Mn: 3.3; acid value: 50) | 5 g |
| Di-tert-butylsalicylic acid metal compound | 3 g |

Particles of the resulting toner were confirmed each to have on their surfaces a plurality of concavities. The R/r of the toner particles was 1.03 and $L/2\pi r$ was 1.03. Cross sections of the toner particles were also observed to confirmed that the phase mainly composed of wax was absent in the vicinity of each toner particle surface ranging from its surface to a depth 0.15 time a toner particle diameter.

A hydrophobic silica was externally added to this toner in the same manner as in Example 18. Then, 6 parts by weight of the resulting toner and 94 parts by weight of a ferrite carrier having been coated with a silicone resin were blended to give a developer.

Using this developer, images were reproduced on a modified machine of a commercially available full-color copier (trade name: Color Laser Copia; manufactured by Canon Inc.). On the surface of the photosensitive member 4 set opposingly to the developing sleeve 3, a latent image with a dark portion of −610 V and a light portion of −190 V was formed as an electrostatic latent image. The space between the surfaces of the sleeve and photosensitive member was set to be 400 μm. Here, develooing was carried out under conditions of −500 V as DC component of the bias power source, 1.2 KHz as a frequency of AC component and 1.2 KVpp applied as a peak-to-peak voltage. At this time the volume percentage of the magnetic particles in the developing zone was 20%.

A 20,000 sheet running test was made under conditions as described above. As a result, images having image density of 1.35 or higher, almost free from fogging and having very high resolution were stably obtained.

Example 23

An aqueous 0.1M $Na_3PO_4$ solution and an aqueous 1M $CaCl_2$ solution were prepared. In a TK-type homomixer (manufactured by Tokushu Kika Kogyo Co., Ltd.), 451 g of the aqueous 0.1M $Na_3PO_4$ solution and 709 g of ion-exchanged water were introduced, followed by stirring at 12,000 rpm. 67.7 g of the aqueous 1M $CaCl_2$ solution was heated to 70° C. and added little by little while the above stirring was carried out using the homomixer to give an aqueous dispersion medium containing $Ca_3(PO_4)_2$.

| | (by weight) |
|---|---|
| Styrene | 170 parts |
| Butyl acrylate | 30 parts |
| Paraffin wax (m.p.: 65° C.) | 35 parts |
| Styrene/methacrylic acid copolymer | 6 parts |
| Phthalocyanine Blue | 12 parts |
| Di-tert-butylsalicylic acid metal compound | 3 parts |

A composition of the above materials was heated to 60° C., and premixed using Ebara Milder (manufactured by Ebara Corporation). While the mixture thus prepared was maintained at 60° C., 10 parts by weight of a polymerization initiator dimethyl 2.2'-azobisisobutylate was added and dissolved to give a polymerizable monomer composition. The monomer composition was introduced in the aqueous $Ca_3(PO_4)_2$ dispersion medium held in a 2 lit. flask of the TK homomixer. Here, the bath temperature was 60° C. and the revolution number of the TK homomixer was 10,000 rpm. A granulated product of the monomer composition was obtained 20 minutes after its introduction. Thereafter, while stirring with a paddle agitating blade, reaction was carried out at 60° C. for 3 hours, and then at an elevated temperature of 80° C. for further 10 hours to complete polymerization. After the polymerization was completed, the reaction system was cooled, and 54 g of 5N hydrochloric acid was added to dissolve the $Ca_3(PO_4)_2$, followed by filtration, washing with water and then drying to give a toner, toner-A.

Particle diameters of the resulting toner-A were measured with a Coulter counter to reveal that the toner had a weight average particle diameter (D4) of 8.1 μm and a sharp particle size distribution. Observation using an electron microscope confirmed that toner particles each had on their surfaces a plurality of concavities. The R/r of the toner particles was 1.08 and $L/2\pi r$ was 1.16. Cross sections of the toner particles were observed on a transmission electron microscope by a method using dyed ultra-thin sections. As a result, it was confirmed that the particles each had a capsule structure separated into the surface layer mainly composed of styrene-acrylic resin and the center mainly composed of wax and that the phase mainly composed of wax was absent in the vicinity of each toner particle surface ranging from its surface to a depth 0.15 time a toner particle diameter.

Based on 100 parts by weight of the toner-A obtained, 0.8 part by weight of hydrophobic silica was externally added to give toner-A to which the hydrophobic silica had been externally added.

The toner-A was set in a copying machine obtained by modifying the developing device of a copier FC-2, manufactured by Canon Inc., to the one as shown in FIG. 8, and images were reproduced to make evaluation. A developer sleeve comprising an aluminum sleeve having on its surface a phenol resin layer in which fine graphite particles had been dispersed was used as the developer carrying member.

As a result, no melt-adhesion of toner to the developer carrying member and to the photosensitive member was seen even after running of 5,000 sheet paper feeding. No image deterioration such as fogging or density decrease was also seen. Offset was also well prevented to give no background stain. The fixing device was set to a temperature of 140° C.

Example 24

Toner-B was obtained in the same manner as in Example 23 except that the colorant used therein was replaced with 5 parts by weight of graft-modified carbon black and the amount of the di-tert-butylsalicylic acid metal compound was changed to 3.5 parts by weight. The toner had an average particle diameter of 8.3 μm.

Based on 100 parts by weight of the toner-B, 0.7 part by weight of hydrophobic silica was externally added to give toner-B to which the hydrophobic silica had been externally added. Using this toner-B and also using the same developing apparatus as in Example 23, images and running performance were evaluated.

As a result, the same good images as those of Example 23 were obtained.

Example 25

Toner-C was obtained in the same manner as in Example 23 except that the amount of the styrene/methacrylic acid copolymer was changed to 4 parts by weight and the colorant was replaced with Permanent Yellow NCG. The toner had an average particle diameter of 8.7 μm. The R/r of the toner particles was 1.05 and $L/2\pi r$ was 1.10.

Based on 100 parts by weight of the toner-C, 0.65 part by weight of hydrophobic silica was externally added to give toner-C to which the hydrophobic silica had been externally added. Using this toner-C and also using the same developing apparatus as in Example 23, images and running performance were evaluated.

As a result, the same good images as those of Example 23 were obtained.

Comparative Example 19

| | (by weight) |
|---|---|
| Styrene/butylacrylate copolymer | 200 parts |
| Paraffin wax (m.p.: 65° C.) | 35 parts |
| Styrene/methacrylic acid copolymer | 6 parts |
| Phthalocyanine Blue | 12 parts |
| Di-tert-butylsalicylic acid metal compound | 3 parts |

A kneaded product of the above materials was prepared to give a toner prepared by pulverization. During its preparation, melt-adhesion of toner to the inside of a pulverizing machine occurred to make pulverization efficiency poor. The resulting pulverized product had so poor a fluidity that blocking occurred and it was difficult to make the product into toner.

Comparative Example 20

The amount of paraffin wax used in Comparative Example 19 was changed to 13 parts by weight. Kneading, pulverization and classification were carried out to give a blue finely pulverized product (average particle diameter: 8.3 μm). Based on 100 parts by weight of the blue finely pulverized product, 0.8 part by weight of hydrophobic silica was externally added to give toner-D. Using this toner-D prepared by pulverization and also using the same developing apparatus as in Example 23, images were reproduced to make running evaluation.

As a result, images were fogged to show deterioration. Melt-adhesion of toner also occurred on the developer carrying member in a 3,000 sheet running test.

Example 26

An aqueous 0.1M $Na_3PO_4$ solution and an aqueous 1M $CaCl_2$ solution were prepared. In a TK-type homomixer (manufactured by Tokushu Kika Kogyo Co., Ltd.), 451 g of the aqueous 0.1M $Na_3PO_4$ solution and 709 g of ion-exchanged water were introduced, followed by stirring at 12,000 rpm. 67.7 g of the aqueous 1M $CaCl_2$ solution was heated to 70° C. and added little by little while the above stirring was carried out using the homomixer to give an aqueous dispersion medium containing $Ca_3(PO_4)_2$.

| | (by weight) |
|---|---|
| Sytrene | 170 parts |
| Butyl acrylate | 30 parts |
| Paraffin wax (m.p.: 70° C.) | 50 parts |
| Styrene/methacrylic acid/methyl methacrylate copolymer (Mw/Mn: 3.1) | 6 parts |
| Phthalocyanine Blue | 12 parts |
| Di-tert-butylsalicylic acid metal compound | 3 parts |

A composition of the above materials was heated to 60° C., and premixed using Ebara Milder (manufactured by Ebara Corporation). While the mixture thus prepared was maintained at 60° C., 10 parts by weight of a polymerization initiator dimethyl 2,2-azobisisobutylate was added and dissolved to give a polymerizable monomer composition. The monomer composition was introduced in the aqueous $Ca_3(PO_4)_2$ dispersion medium held in a flask of the TK homomixer. Here, the bath temperature was 60° C. and the revolution number of the TK homomixer was 10,000 rpm. A granulated product of the monomer composition was obtained 20 minutes after its introduction. Thereafter, while stirring with a paddle agitating blade, reaction was carried out at 60° C. for 3 hours, and then at an elevated temperature of 80° C. for further 10 hours to complete polymerization. After the polymerization was completed, the reaction system was cooled, and 54 g of 5N hydrochloric acid was added to dissolve the $Ca_3(PO_4)_2$, followed by filtration, washing with water and then drying to give a toner, toner-E.

Particle diameters of the resulting toner-E were measured with a Coulter counter to reveal that the toner had a weight average particle diameter of 8.0 μm and a sharp particle size distribution. Observation using an electron microscope confirmed that toner particles each had on their surfaces a plurality of concavities. The R/r of the toner particles was 1.10 and $L/2\pi r$ was 1.18. Cross sections of the toner particles were observed on a transmission electron microscope by a method using dyed ultra-thin sections. As a result, it was confirmed that the particles were each structurally separated into the surface layer mainly composed of styrene-acrylic resin and the center mainly composed of wax and that the phase mainly composed of wax was absent in the vicinity of each toner particle surface ranging from its surface to a depth 0.15 time a toner particle diameter.

Based on 100 parts by weight of the toner-E obtained, 0.8 part by weight of hydrophobic silica having a specific surface area of 200 $m^2/g$ as measured by the BET method was externally added. Next, 7 parts by weight of this toner-E to which the hydrophobic silica had been externally added and 93 parts by weight of a ferrite carrier having been surface-coated with an acrylic resin were blended to give a developer. Using this developer toner, unfixed images were obtained using a full color copier CLC-500, manufactured by Canon Inc.

The unfixed images were fixed using the fixing device as shown in FIG. 9. In this fixing device, the critical surface tension of the film on the side coming into pressure contact with a recording medium was 20 dyne/cm and the surface electrical resistance was $1\times10^6$ Ω·cm. In this fixing device, the temperature sensor surface temperature $T_1$ of the heater element was set to be 130° C., the power consumption of the resistance material of the heating zone, 150 W, the total pressure at the pressure roller, 5 kg, the nip between the pressure roller and film, 4 mm, and the fixing speed, 45 mm/sec. As the heat-resistant sheet, a 20 μm thick polyimide film having a low-resistance release layer provided on the side coming into contact with a recording medium, comprising PTFE to which a conductive material (carbon black) had been added, was used. Here, the time taken for the temperature sensor surface temperature $T_1$ of the heater element to reach 130° C. was about 0.5 second. The temperature $T_2$ at this time was 126° C. and the temperature $T_3$, 126° C.

The fixed images obtained were free from penetration of toner to paper or strike-through. Fixing performance also was so good that good images were obtained without offset to the film. A 2,000 sheet continuous fixing test was also made under the same fixing conditions. As a result, fixing performance was so good that good images were obtained without causing the offset to the film.

EXAMPLE 27

Toner-F was obtained in the same manner as in Example 26 except that the colorant was replaced with Permanent Yellow NCG and the amount of the di-tert-butylsalicylic acid metal compound was changed to 4 parts by weight. The toner had an average particle diameter of 8.4 μm. The R/r of the toner particles was 1.07 and $L/2\pi r$ was 1.17.

Based on 100 parts by weight of the toner-F, 0.7 part by weight of hydrophobic silica was externally added to give toner-F to which the hydrophobic silica had been externally added. Next, 7.5 parts by weight of this toner-F and 93 parts by weight of a ferrite carrier having been surface-coated with an acrylic resin were blended to give a developer. The same fixing test as in Example 26 was made. As a result, the same offset-free good images as those of Example 26 were obtained.

Example 28

An aqueous dispersion medium was prepared in the same manner as in Example 26.

| | (by weight) |
|---|---|
| Styrene | 170 parts |
| 2-Ethylhexyl acrylate | 30 parts |
| Paraffin wax | 40 parts |
| Styrene/methacrylic acid copolymer (Mw/Mn: 3.0) | 6.5 parts |
| Magnetic material (4% treated with a titanium coupling agent) | 140 parts |
| Di-tert-butylsalicylic acid metal compound | 3 parts |

A composition of the above materials was heated to 60° C., and premixed using Ebara Milder (manufactured by Ebara Corporation). While the mixture thus prepared was maintained at 60° C., 10 parts by weight of a polymerization initiator dimethyl 2,2'-azobisisobutylate was added and dissolved to give a polymerizable monomer composition. The monomer composition was introduced in the aqucous $Ca_3(PO_4)_2$ dispersion medium held in a flask of the TK homomixer. Here, the bath temperature was 60° C. and the revolution number of the TK homomixer was 10,000 rpm. A granulated product of the monomer composition was obtained 20 minutes after its introduction. Thereafter, while stirring with a paddle agitating blade, reaction was carried out at 60° C. for and then at an elevated temperature of 80° C. for further 10 hours to complete polymerization. After the polymerization was completed, the reaction system was cooled, and 54 g of 5N hydrochloric acid was added to dissolve the $Ca_3(PO_4)_2$, followed by filtration, washing with water and then drying to give a toner, toner-G.

Particle diameters of the resulting toner-G were measured with a Coulter counter to reveal that the toner had a weight average particle diameter of 9.0 μm and a sharp particle size distribution. Observation using an electron microscope confirmed that toner particles each had on their surfaces a plurality of concavities. The R/r of the toner particles was 1.07 and $L/2\pi r$ was 1.15. Cross sections of the toner particles were observed on a transmission electron microscope by a method using dyed ultra-thin sections. As a result, it was confirmed that the particles were each structurally separated into the surface layer mainly composed of styrene-acrylic resin and the center mainly composed of wax and that the phase mainly composed of wax was absent in the vicinity of each toner particle surface ranging from its surface to a depth 0.15 time a toner particle diameter.

Based on 100 parts by weight of the toner-G obtained, 0.8 part by weight of hydrophobic silica having a specific surface area of 200 $m^2/g$ as measured by the BET method was externally added. Next, 7 parts by weight of this toner-G to which the hydrophobic silica had been externally added and 93 parts by weight of a ferrite carrier having been surface-coated with an acrylic resin were blended to give a developer.

Using this developer toner, unfixed images were obtained using a copier NP-1215, manufactured by Canon Inc.

The unfixed images were fixed using the fixing device as shown in FIG. 9. In this fixing device, the critical surface tension of the film on the side coming into pressure contact with a recording medium was 20 dyne/cm and the surface electrical resistance was $1\times10^6\Omega\cdot$cm. In this fixing device, the temperature sensor surface temperature $T_1$ of the heater element was set to be 140° C., the power consumption of the resistance material of the heating zone, 150 W, the total pressure at the pressure roller, 5 kg, the nip between the pressure roller and film, 4 mm, and the fixing speed, 45 mm/sec. As the heat-resistant sheet, a 20 μm thick polyimide film having a low-resistance release layer provided on the side coming into contact with a recording medium, comprising PTFE to which a conductive material (carbon black) had been added, was used. Here, the time taken for the temperature sensor surface temperature $T_1$ of the heater element to reach 140° C. was about 0.5 second. The temperature $T_2$ at this time was 136° C. and the temperature $T_3$, 136° C.

The fixed images obtained were free from penetration of toner to paper or strike-through. Fixing performance also was so good that good images were obtained without offset to the film. A 5,000 sheet continuous fixing test was also made under the same fixing conditions. As a result, fixing performance was so good that good images were obtained without causing the offset to the film.

Comparative Example 20

| | (by weight) |
|---|---|
| Styrene/butadiene copolymer (17:3) | 200 parts |
| Paraffin wax (m.p.: 70° C.) | 50 parts |
| Styrene/methacrylic acid/methyl methacrylate copolymer | 6 parts |
| Phthalocyanine Blue | 12 parts |
| Di-tert-butylsalicylic acid metal compound | 3 parts |

A kneaded product having the above composition (composition similar to toner-E) was pulverized to attempt to make the product into toner, but it was impossible to do so because of occurrence of melt-adhesion and blocking during its pulverization. In the pulverization method, it was impossible to use a large quantity of release agent.

Comparative Example 21

A toner prepared by pulverization was obtained in the same manner as in Comparative Example 20 except that the release agent was used in an amount of 15 parts by weight. Using this toner, a fixing test was made in the same manner as in Example 26. As a result, the offset occurred. Blocking resistance also was deteriorated.

As having been described above, according to the present invention, it is possible to obtain a toner free from deterioration with time and having a superior durability. Because of its superiority in fixing performance, blocking resistance, charge stability, storage stability, etc., it is also possible to obtain very sharp images having a high image density and free from coarseness.

According to the image forming method of the present invention, it is possible to obtain images with a high image density and a superior resolution, and to form stable images without changes in toner performance even in use for a long period of time.

According to the image forming method and the heat fixing method, of the present invention, it is possible to obtain images free from image deterioration such as fogging. During fixing, it is also possible to make waiting time substantially zero or short, and to achieve a low power consumption and prevent offset from occurring.

What is claimed is:

1. A developer for developing an electrostatic image, comprising a toner, said toner comprising toner particles each containing a polymer, a copolymer or a mixture thereof and from 5 to 30% by weight of a low softening point material having a melting point of from 30° C. to 130° C., each of said toner particles having a plurality of concavities on its surface, and $Ca_3(PO_4)_2$ being present on the surface of said toner particles in an amount of not more than 0.2% by weight based on the weight of said toner; said toner particles being prepared by suspension polymerization.

2. The developer according to claim 1, wherein said low softening point material is present in a central portion of the toner particle and forms central phase B.

3. The developer according to claim 2, wherein said phase-B formed of said low softening point material holds from 10% to 45% in a cross section of said toner particle.

4. The developer according to claim 1, wherein said toner comprises toner particles prepared by suspension polymerization in the presence of fine calcium phosphate particles, and calcium phosphate is present on the surface of each of said toner particles in an amount of from 0.005% by weight to 0.2% by weight on the basis of said toner.

5. The developer according to claim 1, wherein said toner particles are each a toner particle whose maximum inscribed circle corresponding to its radius r and minimum circumscribed circle corresponding to its radius R with respect to a projected area of the toner particle, satisfy the relationship:

$$1.00 < R/r \leqq 1.20,$$

and concavities are formed on said toner particle in such a fashion that circumferential length L and circumferential length $2\pi r$ of a projected area of said toner particle satisfy the relationship:

$$1.01 < L/2\pi r < 2.00.$$

6. The developer according to claim 1, wherein said low softening point material comprises a low melting point wax.

7. The developer according to claim 1, wherein said low softening point material comprises a low melting point wax having a melting point of from 30° C. to 130° C.

8. The developer according to claim 1, wherein said toner comprises toner particles prepared from a polymerizable monomer composition containing a polar resin, a low softening point material, a polymerizable monomer, a polymerization initiator and a colorant, by suspension polymerization in an aqueous medium containing fine calcium phosphate particles.

9. The developer according to claim 8, wherein said polymerizable monomer comprises a styrene monomer.

10. The developer according to claim 8, wherein said polymerizable monomer comprises a mixture of a styrene monomer and an acrylic monomer.

11. The developer according to claim 8, wherein said polymerizable monomer comprises a styrene monomer, said low softening point material comprises a low melting point wax and said polar resin has an acid value of from 20 to 100.

12. A developer for developing an electrostatic latent image, comprising a toner comprising toner particles; said toner particles being prepared by suspension polymerization, each containing at least two components comprised of a high softening point resin-A and a low softening point material-B, and each having a structure separated into a phase-A mainly composed of said resin-A and a phase-B mainly composed of said material-B, said phase mainly composed of said material-B being absent in the vicinity of the toner particle surface ranging from its surface to a depth 0.15 time a toner particle diameter; and a dispersion stabilizer being present on the surfaces of said toner particles in an amount of not more than 0.2% by weight based on the weight of said toner.

13. The developer according to claim 12, wherein said dispersant used in said suspension polymerization is $Ca_3(PO_4)_2$, said $Ca_3(PO_4)_2$ being produced by reacting at least two compounds.

14. The developer according to claim 12, wherein said toner particles are each a toner particle whose maximum inscribed circle corresponding to its radius r and minimum circumscribed circle corresponding to its radius R with respect to a projected area of the toner particle, satisfy the relationship:

$$1.00 < R/r \leqq 1.20,$$

and an unevenness is formed on the surface of said toner particle in such a fashion that circumferential length L and circumferential length $2\pi r$ of a projected area of said toner particle satisfy the relationship:

$$1.01 < L/2\pi r < 2.00.$$

15. The developer according to claim 12, wherein the proportion of said two components A and B of said toner is in the range of from 50:50 to 95:5.

16. The developer according to claim 12, wherein the proportion of said low softening point material-B comprises a low melting point wax.

17. The developer according to claim 12, wherein said low softening point material-B has a melting point of from 30° C. to 130° C.

18. The developer according to claim 12, wherein said toner contains said low softening point material-B in an amount of from 5% by weight to 30% by weight, and has a plurality of concavities on the surface of its each toner particle.

19. An image forming method comprising;

forming on a developer carrying member a magnetic brush layer formed of a developer; said developer comprising toner particles and magnetic particles; said toner particles each being prepared by suspension polymerization, containing at least two components comprised of a high softening point resin-A and a low softening point material-B having a melting point of from 30° C. to 130° C., and each having a structure separated into a phase-A mainly composed of said resin-A and a phase-B mainly composed of said material-B, said phase mainly composed of said material-B being absent in the vicinity of the toner particle surface ranging from its surface to a depth 0.15 time a toner particle diameter;

applying across said developer carrying member and a latent image bearing member, a bias electric field formed of an alternating current component and a direct current component; and forming in a developing zone defined by said latent image bearing member and said developer carrying member, a magnetic brush in such a manner that said magnetic particles are in a volume percentage of from 10% to 40%.

20. The image forming method according to claim 19, wherein said toner particles are each a toner particle whose maximum inscribed circle corresponding to its radius r and minimum circumscribed circle corresponding to its radius R with respect to a projected area of the toner particle, satisfy the relationship:

$$1.00 < R/r \leqq 1.20,$$

and an unevenness is formed on the surface of said toner particle in such a fashion that circumferential length L and circumferential length $2\pi r$ of a projected area of said toner particle satisfy the relationship:

$$1.01 < L/2\pi r < 2.00.$$

21. The image forming method according to claim 19, wherein the proportion of said two components A and B of said toner is in the range of from 50:50 to 95:5.

22. The image forming method according to claim 19, wherein said low softening point material-B comprises a low melting point wax.

23. The image forming method according to claim 19, wherein said low softening point material-B has a melting point of from 30° C. to 130° C.

24. The image forming method according to claim 19, wherein said toner contains said low softening point material-B in an amount of from 5% by weight to 30% by weight, and has a plurality of concavities on the surface of its each toner particle.

25. The image forming method according to claim 19, wherein said magnetic particles have an average particle diameter of from 20 μm to 80 μm, and contain fine powder of 400 mesh or less in an amount of not more than 20% by weight and coarse powder of 250 mesh or more in an amount of not more than 20% by weight.

26. An image forming method comprising;

feeding a toner to a developer carrying member by means of a feed roller; said toner comprising non-magnetic toner particles; said non-magnetic toner particles being prepared by suspension polymerization, each containing at least two components comprised of a high softening point resin-A and a low softening point material-B having a melting point of from 30° C. to 130° C., and each having a structure separated into a phase-A mainly composed of said resin-A and a phase-B mainly composed of said material-B, said phase mainly composed of said material-B being absent in the vicinity of the toner particle surface ranging from its surface to a depth 0.15 time a toner particle diameter;

forming a toner layer on said developer carrying member by means of a developer coating blade provided downstream said feed roller; and developing with said toner an electrostatic image formed on a latent image bearing member set opposingly to said developer carrying member.

27. The image forming method according to claim 26, wherein said developer carrying member has on its surface a resin layer containing at least fine particles having a solid lubricity.

28. The image forming method according to claim 26, wherein a minute space is formed between said latent image being member and the surface of said toner layer on the developer carrying member, and an alternating electric field is applied across said space.

29. The image forming method according to claim 26, wherein said toner particles are each a toner particle whose maximum inscribed circle corresponding to its radius r and minimum circumscribed circle corresponding to its radius R with respect to a projected area of the toner particle, satisfy the relationship:

$$1.00 < R/r \leqq 1.20,$$

and concavities are formed on said toner particle in such a fashion that circumferential length L and circumferential length $2\pi r$ of a projected area of said toner particle satisfy the relationship:

$$1.01 < L/2\pi r < 2.00.$$

30. The image forming method according to claim 26, wherein the proportion of said two components A and B of said toner is in the range of from 50:50 to 95:5.

31. The image forming method according to claim 26, wherein said low softening point material-B comprises a low melting point wax.

32. The image forming method according to claim 26, wherein said low softening point material-B has a melting point of from 30° C. to 130° C.

33. The image forming method according to claim 26, wherein said toner contains said low softening point material-B in an amount of from 5% by weight to 30% by weight, and has a plurality of concavities on the surface of its each toner particle.

34. A heat fixing method comprising:

carrying a visible image of a toner onto a recording medium; said toner comprising toner particles; said toner particles being prepared by suspension polymerization, each containing at least two components comprised of a high softening point resin-A and a low softening point material-B having a melting point of from 30° C. to 130° C., and each having a structure separated into a phase-A mainly composed of said resin-A and a phase-B mainly composed of said material-B, said phase mainly composed of said material-B being absent in the vicinity of the toner particle surface ranging from its surface to a depth 0.15 time a toner particle diameter; and bringing said recording medium into close contact with a heating element by means of a pressure member, with a film interposed between them, to heat-fix said visible image of said toner onto said recording medium.

35. The heat fixing method according to claim 34, wherein said toner particles are each a toner particle whose maximum inscribed circle corresponding to its radius r and minimum circumscribed circle corresponding to its radius R with respect to a projected area of the toner particle, satisfy the relationship:

$$1.00 < R/r \leqq 1.20,$$

and concavities are formed on said toner particle in such a fashion that circumferential length L and circumferential length $2\pi r$ of a projected area of said toner particle satisfy the relationship:

$$1.01 < L/2\pi r < 2.00.$$

36. The heat fixing method according to claim 34, wherein said two components A and B of said toner is in the range of from 50:50 to 95:5.

37. The heat fixing method according to claim 34, wherein said low softening point material-B comprises a low melting point wax.

38. The heat fixing method according to claim 34, wherein said low softening point material-B has a melting point of from 30° C. to 130° C.

39. The heat fixing method according to claim 34, wherein said toner contains said low softening point material-B in an amount of from 5% by weight to 30% by weight, and has a plurality of concavities on the surface of its each toner particle.

* * * * *

UNITED STATES PATENT AND TRADEMARK OFFICE

CERTIFICATE OF CORRECTION

PATENT NO. : 5,300,386

DATED : April 5, 1994

INVENTOR(S) : MAKOTO KANBAYASHI, ET AL.

It is certified that error appears in the above-identified patent and that said Letters Patent is hereby corrected as shown below:

COLUMN 1

Line 7, "invention" should read --Invention--.
Line 14, "method" should read --methods--.
Line 27, "on" should read --in--.

COLUMN 5

Line 33, "comprising;" should read --comprising:--.
Line 58, "comprising;" should read --comprising:--.

COLUMN 6

Line 10, "comprising;" should read --comprising:--.

COLUMN 8

Line 3, "preferably" should read --preferably be--.
Line 59, "instead" should read --also--.

COLUMN 11

Line 48, "form" should read --form in which--.

COLUMN 13

Example (4), "$Zncl_2$" should read --$ZnCl_2$--.

COLUMN 14

Line 18, "Brønsted" should read --Brönsted--.
Line 26, "Brønsted" should read --Brönsted--.

UNITED STATES PATENT AND TRADEMARK OFFICE

CERTIFICATE OF CORRECTION

PATENT NO. : 5,300,386

DATED : April 5, 1994

INVENTOR(S) : MAKOTO KANBAYASHI, ET AL.

It is certified that error appears in the above-identified patent and that said Letters Patent is hereby corrected as shown below:

COLUMN 14

Line 36, "The" should read --the--.
Line 38, "Bronsted" should read --Brönsted--.

COLUMN 16

Line 8, "Nigrosine" should read --nigrosine--.

COLUMN 17

Line 64, "does not" should be deleted.

COLUMN 18

Line 4, "an" should read --can--.

COLUMN 21

Line 65, "adhere" should read --adheres--.

COLUMN 22

Line 59, "may" should read --need--.

COLUMN 23

Line 39, "is" should read --are--.

UNITED STATES PATENT AND TRADEMARK OFFICE

CERTIFICATE OF CORRECTION

PATENT NO. : 5,300,386

DATED : April 5, 1994

INVENTOR(S) : MAKOTO KANBAYASHI, ET AL.

It is certified that error appears in the above-identified patent and that said Letters Patent is hereby corrected as shown below:

COLUMN 24

Line 19, "sample" should read --samples--.
Line 24, "The" should read --the--.
Line 33, "Sample" should read --Samples--.

COLUMN 25

Line 2, "285+6" should read --285±6--.

COLUMN 27

Line 32, "Example b 30" should read --Example 30--.

COLUMN 30

Line 18, "environments" should read --environment--.
Line 19, "little changed" should read --changed little--.

COLUMN 32

Line 45, "polymer" should be deleted.
Line 54, "50°C.," should read --60°C.,--.

COLUMN 33

Line 33, "CLO-500," should read --CLC-500,--.
Line 39, "spent" should read --wear--.

COLUMN 34

Line 44, "Copia;" should read --Copier--.
Line 48, "maximum)" should read --maximum;--.

UNITED STATES PATENT AND TRADEMARK OFFICE

CERTIFICATE OF CORRECTION

PATENT NO. : 5,300,386

DATED : April 5, 1994

INVENTOR(S) : MAKOTO KANBAYASHI, ET AL.

It is certified that error appears in the above-identified patent and that said Letters Patent is hereby corrected as shown below:

COLUMN 35

Line 34, "spent" should read --wear--.

COLUMN 36

Line 59, "running proceeds" should read --copying proceeds--.

COLUMN 37

Line 16, "confirmed" should read --confirm--.
Line 28, "carrier-spent" should read --carrier-wear--.

COLUMN 38

Line 22, "on" should read --after-- and "sheet coying" should read --sheets were copied--.
Line 23, "carrier-spent" should read --carrier-wear--.
Line 55, "Copia;" should read --Copier;--.
Line 63, "develooing" should read --developing--.
Line 64, "1.2 KHz" should read --1.2 kHz--.
Line 65, "1.2 KVpp" should read --1.2 kVpp.

COLUMN 39

Line 32, "2.2'-" should read --2,2'- --.

COLUMN 41

Line 43, "2,2-" should read --2,2'- --.

UNITED STATES PATENT AND TRADEMARK OFFICE

CERTIFICATE OF CORRECTION

PATENT NO. : 5,300,386

DATED : April 5, 1994

INVENTOR(S) : MAKOTO KANBAYASHI, ET AL.

It is certified that error appears in the above-identified patent and that said Letters Patent is hereby corrected as shown below:

COLUMN 48

Line 67, "toner is" should read --toner are--.

COLUMN 50

Line 5, "of its each" should read --of each--.

Signed and Sealed this

Twenty-fifth Day of October, 1994

*Attest:*

*Attesting Officer*

BRUCE LEHMAN

*Commissioner of Patents and Trademarks*